US006785972B2

(12) United States Patent
Goldberg

(10) Patent No.: US 6,785,972 B2
(45) Date of Patent: Sep. 7, 2004

(54) METHOD AND SYSTEM FOR RECORDING A VIEWING POINT

(76) Inventor: Varda Goldberg, 4/5 Remez Street, Givatayim (IL)

( * ) Notice: Subject to any disclaimer, the term of this patent is extended or adjusted under 35 U.S.C. 154(b) by 0 days.

(21) Appl. No.: 10/051,068

(22) Filed: Jan. 22, 2002

(65) Prior Publication Data

US 2003/0009889 A1 Jan. 16, 2003

(51) Int. Cl.[7] ..... B43L 13/14
(52) U.S. Cl. ..... 33/1 K; 33/18.3; 33/277
(58) Field of Search ..... 33/1 K, 18.3, 20.3, 33/276, 277, 1 G, 23.01, 666, 562, 574

(56) References Cited

U.S. PATENT DOCUMENTS

| | | | | | |
|---|---|---|---|---|---|
| 9,409 | A | * | 11/1852 | Richter | 33/1 K |
| 241,801 | A | * | 5/1881 | Hagan | 33/1 K |
| 561,797 | A | * | 6/1896 | Langworthy | 33/277 |
| 1,622,229 | A | * | 3/1927 | Ormiston | 33/1 K |
| 3,660,903 | A | * | 5/1972 | Caperton, Jr. | 33/276 |
| 3,678,589 | A | * | 7/1972 | Baier | 33/277 |
| 3,803,720 | A | * | 4/1974 | Helava | 33/277 |
| 4,097,998 | A | * | 7/1978 | Klimavicz et al. | 33/1 G |
| 4,168,573 | A | | 9/1979 | Chase | |
| 4,367,949 | A | * | 1/1983 | Lavering | 33/277 |
| 4,432,140 | A | * | 2/1984 | Santamaria Ulecia | 33/20.3 |
| 4,672,747 | A | * | 6/1987 | Turner | 33/1 K |
| 4,730,398 | A | * | 3/1988 | Stanton | 33/1 K |
| 4,972,590 | A | * | 11/1990 | Dentith | 33/1 K |
| 5,580,250 | A | * | 12/1996 | McKewen | 434/91 |
| D379,371 | S | * | 5/1997 | Nicholl et al. | D19/35 |
| 6,579,099 | B1 | * | 6/2003 | Pipes, Jr. | 33/1 K |

* cited by examiner

*Primary Examiner*—Diego Gutierrez
*Assistant Examiner*—Madeline Gonzalez
(74) *Attorney, Agent, or Firm*—Mark M. Friedman

(57) ABSTRACT

The present invention is a method and system for recording a point in space, which is to be used as the viewing point of from which the eye of an artist will view a copy easel and the subject to be copied. This viewing point is recorded so as to allow the artist to move the eye from this viewing point and return the eye to the same specific viewing point in order to continue drawing. This is accomplished by placing a portion of a figure, into which a pair of reference points has been incorporated, on the drawing surface of the easel. A second complimentary portion of the figure, into which a second pair of reference points has been incorporated, is placed behind the drawing surface of the easel. The second portion of the figure is positioned so as, when seen from the viewing point, to appear to complete the figure and align the two pairs of reference points. In order to return the eye to the recorded viewing point, the artist simply changes the position of the eye until the figure appears complete and the reference points are aligned, as when first positioned.

26 Claims, 18 Drawing Sheets

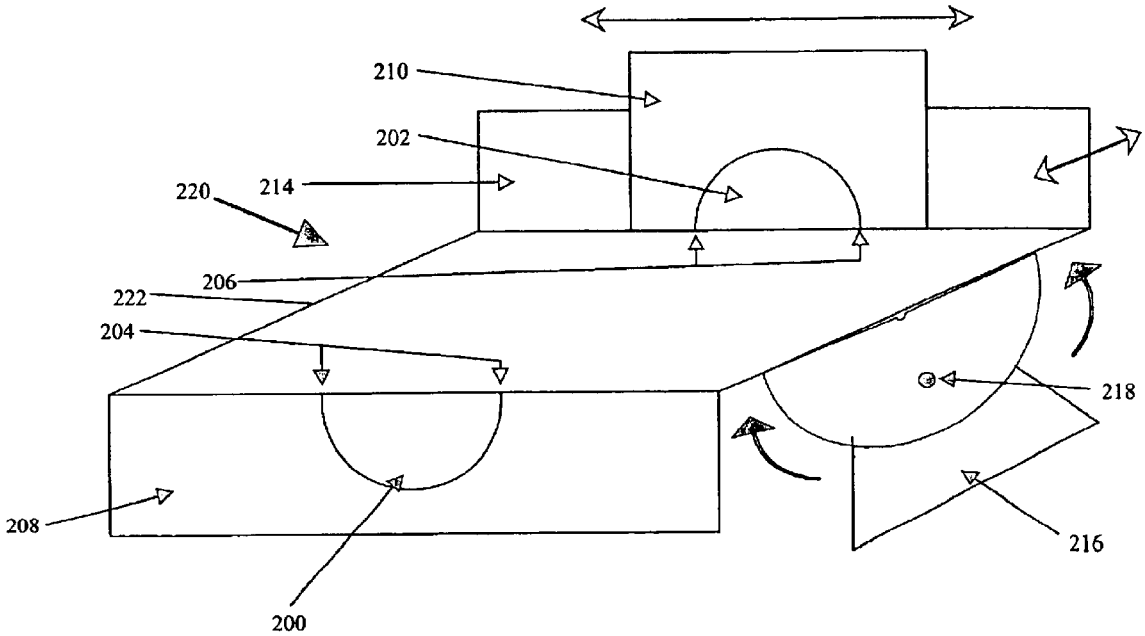
FIG. 22a
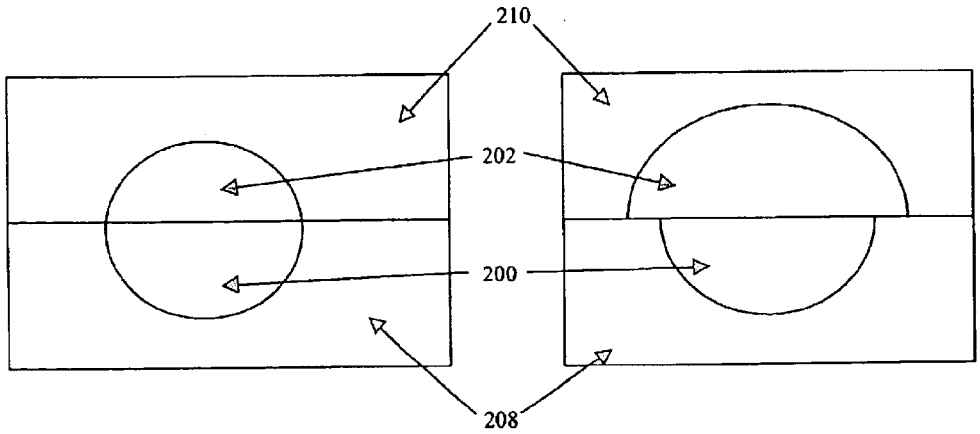
FIG. 22b
FIG. 22c

METHOD AND SYSTEM FOR RECORDING A VIEWING POINT

FIELD AND BACKGROUND OF THE INVENTION

The present invention relates to a method and system for recording a point in space that is to be used as the viewing point of from which the eye, for example of an artist, will view a scene, for example a copy easel and the subject to be copied and, in particular, it concerns recording the viewing point in such a way as to allow the removal of the eye from this viewing point and return of an eye, not necessarily the same eye or the same viewer, to the same specific viewing point in order to continue viewing with the same perspective as before.

There are known copy easels that are made of transparent materials so as to allow an artist to make a copy drawing of a subject, which is positioned on the opposite side of the easel from the artist.

It is further known that, when using a copy easel, the eye must remain stationary in order for the perspective, scale, and alignment of the drawing to be maintained. Any change in the distance between the artist's eye and the subject, will effect the scale of any subsequent drawing. Any change in the angle of the line of sight, in relation to the line to infinity, will effect the perspective and alignment of any subsequent drawing.

There is further known, a sighting awning, such as referred to in U.S. Pat. No. 4,168,573, that, when attached to a copy easel, defines a sighting opening. This sighting opening, while providing a means to preserve the scale, perspective, and alignment of the drawing, proves to be an inflexible way to define the point in space where the artist's eye must be in order to effectively use the copy easel. The location of the opening is defined by the awning's designer, incorporating any limitations brought about by design or manufacturing requirements. Further, this awning restricts the user's field of vision and obscures portions of the drawing surface.

There is therefore a need for a method and system for recording the exact point in space, which is to be used as the viewing point, of from which the eye of an artist will view a copy easel and the subject to be copied, that is flexible and that allows for the comfort and personal preferences of the artist using the copy easel, and does not restrict the user's field of vision or obscure portions of the drawing surface.

SUMMARY OF THE INVENTION

The present invention is a method and system for recording a point in space that will be used as the viewing point from which the eye of an artist will view a copy easel and the subject to be copied.

According to the teachings of the present invention there is provided, that during use, the elements of the present invention are viewed monocularly, which renders visual perception two-dimensional.

According to a further teaching of the present invention, the viewing point is recorded in such a way as to allow the eye to be returned to the recorded viewing point if the position of the eye is changed.

According to a further teaching of the present invention, each reference point, of a first pair of reference points, is designated by use of at least a first graphic form.

According to a further teaching of the present invention, each reference point, of a second pair of reference points, is designated by use of graphic forms, so that the first pair of reference points is located between the second pair of reference points and the eye.

According to a further teaching of the present invention, the reference points are positioned so that, when seen from the viewing point, the at least a first graphic form designating the reference points of the first pair of reference points is aligned with a corresponding graphic form designating the reference points of the second pair of reference points.

According to a further teaching of the present invention, the eye is returned to the viewing point by changing the position of the eye until each of the at least a first graphic form designating the reference points of the first pair of reference points is aligned with a corresponding graphic form designating the reference points of the second pair of reference points.

According to a further teaching of the present invention, the designation of the first pair of reference points includes placement of the graphic forms, of the first pair of reference points, on the transparent drawing surface of a copy easel.

According to a further teaching of the present invention, the designation of the second pair of reference points includes placement of the graphic forms, of the second pair of reference points, on a surface behind the copy easel.

According to a further teaching of the present invention, the alignment of the two sets of reference points is accomplished by repositioning the second pair of reference points.

According to a further teaching of the present invention, the rotation of the second pair of reference points is restricted during transitional movement that occurs during the positioning.

According to a further teaching of the present invention, the restriction includes a mechanical element.

According to a further teaching of the present invention, the pairs of reference points are incorporated into complimentary portions of a figure, the figure having a normal appearance such that proper alignment of the pairs of reference points will further result in the proper alignment of the portions of the figure so as to make the figure appear to be complete and normal.

According to a further teaching of the present invention, the second pair of reference points is designated as end points of a line segment.

According to a further teaching of the present invention, the line segment is chosen from a group of line segments of varying lengths.

According to a further teaching of the present invention, the line segments are distinguished such that individual line segments are identifiable.

According to a further teaching of the present invention, the first set of reference points is incorporated into the figure of a clown face, consisting of a semi-circle, in which facial features have been drawn, that is printed on a card so that the straight edge of the semi-circle is coincidental to the top edge of the card, with the first pair of reference points being the end points of the straight line, and a vertical line that bisects the semi-circle is also printed.

According to a further teaching of the present invention, the second set of reference points are chosen from graduations which are incorporated into a drawing of a clown hat that is in the shape of an isosceles triangle with horizontal graduations, and a line which bisects the triangle.

According to a further teaching of the present invention, alignment is accomplished by aligning the two portions of the figure so that the hat appears to be resting directly above the clown face, and the vertical line that bisects the triangle of the hat and the vertical line that bisects the clown face, appear to be a continuous line.

According to a further teaching of the present invention, the line may appear as a straight line, or it may appear as a line which bends at an angle at the point of intersection of the hat and the clown face.

According to a further teaching of the present invention, the eye may be returned to the viewing point by use of the following steps: align the two lines which bisect the hat and the clown face respectively; align the line segment which is the top of the clown face with the corresponding reference graduation in the hat; move the eye toward or away from the easel until the hat is the same size as the clown face.

According to a further teaching of the present invention, the reference points of the second pair of reference points are designated by a device that includes a mechanism that varies the distance between two reference points, enabling the device to designate a pair of reference points that are separated by a selected distance.

According to a further teaching of the present invention, the device consists of: a card, into which two vertical slits have been cut, and onto which a triangular hat has been drawn; a transparent crossbar which passes horizontally over the card and through the slits, coming out from under the card at both sides; an opaque bar, printed on the crossbar, which serves as an indicator for the second set of reference points; and an inverted triangle printed above the mid-point of opaque bar.

According to a further teaching of the present invention, the device is used in conjunction with a depiction of a clown face, which is printed on a card.

According to a further teaching of the present invention, the card that has the clown face printed on it is placed on the drawing surface of the easel.

According to a further teaching of the present invention, the card with the hat printed on it is positioned behind the drawing surface of the easel so that the hat appears to be resting directly above the clown face.

According to a further teaching of the present invention, the crossbar is repositioned so that the top edge of the opaque bar appears to be contiguous with the top edge of the clown face and the bar disappears behind the card, and the inverted triangle appears to be resting directly on the top of the line that bisects the clown face.

According to a further teaching of the present invention, the at least a first graphic form includes implementation as at least two graphic forms, of the first pair of reference points.

According to a further teaching of the present invention, the at least a second graphic forms includes implementation as at least two graphic forms, of the second pair of reference points.

According to a further teaching of the present invention, the designation of the first pair of reference points includes placement of the graphic forms, of the first pair of reference points, on a track, the track being deployed below the transparent drawing surface of a copy easel, the track being elevated above the surface upon which it is supported, the graphic forms including pointers slidably attached to the track.

According to a further teaching of the present invention, the designation of the second pair of reference points includes placement of the graphic forms, of the second pair of reference points, on a rule deployed on a surface behind the copy easel, the graphic forms including pointers slidably attached to the rule.

According to a further teaching of the present invention, the alignment includes the positioning being performed on at least one of the pointers of the reference points.

According to a further teaching of the present invention, the designation of the first pair of reference points includes placement of the graphic forms, of the first pair of reference points, on a first track, the first track having a first edge, the first track being deployed on a movable frame, the graphic forms including pointers slidably attached to the first track.

According to a further teaching of the present invention, the designation of the second pair of reference points includes placement of the graphic forms, of the second pair of reference points, on a second track, the second track having a second edge, the second track being deployed on the movable frame such that the second edge is co-planer with the first edge, the graphic forms including pointers slidably attached to the second track.

According to a further teaching of the present invention, the alignment includes moving the movable frame until the viewing point lies in the plane of the first and second edges, and the positioning being performed on at least one of the pointers of the reference points.

According to a further teaching of the present invention, the designation of the first pair of reference points includes placement of the at least a first graphic form, of the first pair of reference points, on a first surface of a frame, the first surface being connected to, extending below and perpendicular to, a front edge of a second surface of said frame, said frame further having a third surface that extends above and perpendicular to the second surface, the third surface also being parallel to the first surface, the frame being supported so as to allow vertical and horizontal rotation, the at least a first graphic form, of the first pair of reference points, being deployed such that the first pair of reference points are located on the edge along which the first and second surfaces are connected.

According to a further teaching of the present invention, the designation of the second pair of reference points includes placement of the at least a second graphic form, of the second pair of reference points, on a fourth, non-connected surface, the at least a second graphic form, of the second pair of reference points, being deployed such that the second pair of reference points are located on an edge of the fourth surface, the fourth surface being deployed on the second surface and supported by the third surface so as to be perpendicular to the second surface, and orientated such that the edge on which said second pair of reference points is located is the edge of the fourth surface which is in connect with the second surface.

According to a further teaching of the present invention, the alignment includes vertical and horizontal rotation of the frame.

According to a further teaching of the present invention, positioning includes vertical movement of the fourth surface.

According to a further teaching of the present invention, the designation of the first pair of reference points includes placement of the at least a first graphic form, of the first pair of reference points, on a first surface of a frame member, the frame member being adjustably attached to an easel frame, the easel frame further including foldable legs thereby providing support for the easel frame.

According to a further teaching of the present invention, designation of the second pair of reference points includes placement of the at least a second graphic form, of the second pair of reference points, on a reference component, the reference component being slidably mounted on a second surface of the frame member such that the at least a first graphic form is located between said at least a second graphic form and the eye.

According to a further teaching of the present invention, the alignment is accomplished by the positioning being performed on the frame member and the reference component.

There is also provided according to the teachings of the present invention, a system for making a copy drawing of a subject, the system comprising: a) a copy easel, configured with a transparent drawing surface and a base which holds the drawing surface substantially vertical while in use; and b) an apparatus for designation of reference points, the apparatus being adjustable so as to allow for alignment of the reference points.

According to a further teaching of the present invention, the transparent drawing surface and the base are constructed of a single piece of transparent material with the base extending behind the drawing surface.

According to a further teaching of the present invention, the apparatus for designation of reference points includes a figure, which designates a first pair of reference points, is fixed upon the drawing surface, an alignment piece, upon which a figure that designates a second pair of reference points is depicted, and a mechanism that restricts the movement of the alignment piece to a preferred direction of alignment fixed to a top surface of the base.

According to a further teaching of the present invention, the apparatus for designation of reference points includes an elevated graduated track and a graduated rule both of which are deployed on the surface below the copy ease, the graduated track and the graduated rule each including at least two slidably attached reference pointers.

According to a further teaching of the present invention, the apparatus for designation of reference points includes a movable frame including two graduated rules, the graduated rules being co-planer, both of the graduated rules including at least two slidably attached reference pointers.

According to a further teaching of the present invention, there is further included a device for covering an eye.

According to a further teaching of the present invention, there is further included a device for supporting a head of a user.

BRIEF DESCRIPTION OF THE DRAWINGS

The invention is herein described, by way of example only, with reference to the accompanying drawings, wherein:

FIG. 22*a* is a isometric view of a preferred embodiment of the present invention on a freestanding frame;

FIG. 22*b* and FIG. 22*c* are schematic views showing the proper alignment and misalignment respectively of the graphic forms of the present invention;

DESCRIPTION OF THE PREFERRED EMBODIMENTS

Figure 1:
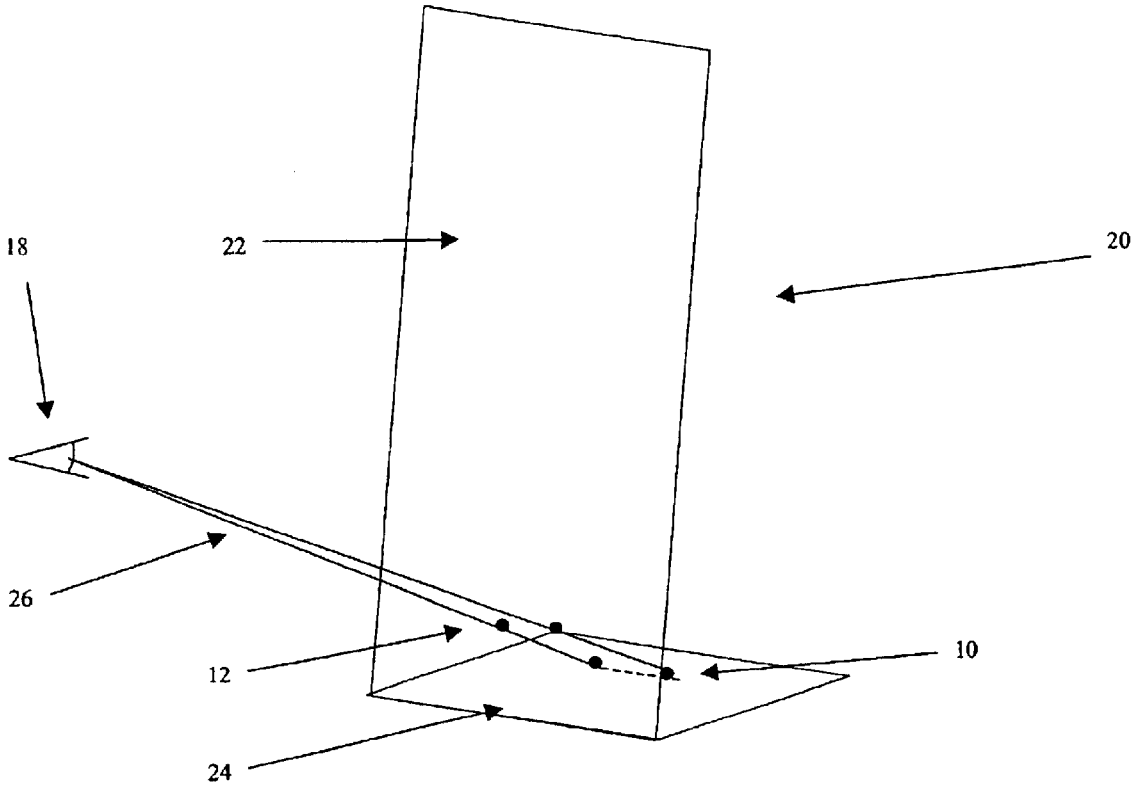
FIG. 1 is an isometric view of the basic elements of the present invention placed on a copy easel.

The present invention is a method and system for recording a point in space that is to be used as the viewing point of from which the eye, for example of an artist, will view a scene, for example a copy easel and the subject to be copied and, in particular, it concerns recording the viewing point in such a way as to allow the removal of the eye from this viewing point and return of an eye, not necessarily the same eye or the same viewer, to the same specific viewing point in order to continue viewing with the same perspective as before By way of introduction, a basic principle of the present invention is that any two non-parallel lines lying in the same plane will intersect at only one unique point in space. Further, when viewed from a point on a line, all of the points on that line in one direction from that "viewing point" will be superimposed on each other and will therefore appear as a single point. Also important are that two points define a line and two lines define a plane. In bringing these principles together, the present invention uses the viewing point of an eye as the point intersection of two lines. Two vectors of those lines are then defined by designating two points, other that the point of intersection, along each of the vectors. These vectors, however, when viewed from the point of intersection, herein referred to as the "viewing point", will appears as two separate points. Or, more particular to the present invention, each of the points in the two pair of designating points, which the present invention uses to define the two vectors, will be superimposed on the other point in it's pair and the two pair of points will appear as two single points.

An apparatus for designation of reference points is positioned between the subject and the eye of the artist. It is necessary to record the viewing point in such a way as to allow the artist to move the eye away from the viewing point, during a copy drawing process, and return the eye to the viewing point in order to continue the drawing process. It should be noted here that, the venue for use of the present invention need not be limited solely to copy easels. Certainly the principles, and some of the devices described herein as non-limiting examples, could be applied to other situations where it is desirable to bring a viewer to a particular predetermined viewing point, such as, but not limited to, the art of sculpture or informational tourist viewing points.

The use of copy easels requires that the drawing be done using only one eye. This is necessary to maintain the perspective and alignment of the copy. The use of only one eye results in everything appearing two-dimensional. The accompanying discussion will describe the present invention, as it would appear to the user, that is, in two-dimensional terms. Here too, the term "graphic form", while it generally refers to two-dimensional elements, herein it is used with regard to any element which designates any of the reference points of the present invention whether the element be two-dimensional or three-dimensional.

The artist is to be positioned comfortably in relation to the copy easel and the subject. The artist will then establish which eye will view the easel and subject and which point in space the eye will use as the viewing point. The intention of the present invention is to record the viewing point of an artist's eye once the viewing point has been established, allowing the eye to be returned to the viewing point if it is moved away.

The principles of the present invention may be embodied in numerous ways, by way of non-limiting examples, the discussion here will include preferred embodiments that have components that are incorporated into a copy easel, a preferred embodiment that is deployed below a copy easel and two preferred embodiments that may be positioned near a copy easel to suit the preferences of the user. The preferred embodiments with components incorporated into a copy easel will be discussed in FIGS. 1–17. The preferred embodiment deployed below a copy easel will be discussed in FIGS. 18*a* and 18*b*. The preferred embodiments that may be deployed near a copy easel will be discussed in FIGS. 19*a* and 19*b*, and in FIGS. 22*a, b*, and *c*.

The principles and operation of recording a viewing point according to the present invention may be better understood with reference to the drawings and the accompanying description.

In a first preferred embodiment of the present invention, the viewing point is recorded by placing a figure, or graphic forms, which designate a first pair of reference points, on the transparent drawing surface of the easel. The figure, or graphic form, which designate a second pair of reference points, is placed on a surface that is behind the drawing surface of the copy easel. Preferred embodiments referred to here utilize the surface of the base of the easel, which extents behind the drawing surface, for placement of the second pair of reference points.

The pairs of reference points are positioned so that each of the figures, or graphic forms, which designate reference points, of the first pair of reference points is aligned with a figure, or graphic form, which designates a corresponding reference point, of the second pair of reference points.

When the pairs of reference points are aligned, the viewing point is recorded and the eye may be moved from the viewing point. To return the eye to the viewing point, the eye is moved around until each of the figures designating reference points of the first pair is aligned with the figure designating a corresponding reference point of the second pair of reference points.

Referring now to the drawings, FIG. 1 shows a copy easel 20 comprised of a base 24 and a transparent drawing surface 22. A first pair of reference points 12, designated by the graphic forms of round dots, is positioned on the lower portion of the drawing surface. A second pair of reference points 10, also designated round dots, is positioned on the base, behind the drawing surface. When the two sets of reference points are viewed together with the eye 18 whose position the reference points are recording, they appear to form a triangle with the eye at the vertex and the reference points of the second set of reference points 10 at the end points of the base. The reference points of the first set of reference points 12 lie on the lines 26 from the eye to the end points of the base, these lines forming the sides of the triangle.

A preferred embodiment of the present invention simplifies the process of alignment by incorporating the pairs of reference points into complimentary portions of a figure. The portions of the figure have a predetermined relationship such that aligning the portions of the figure, so as to achieve the predetermined relationship, results in the proper alignment of the reference points.

An example of this embodiment of present invention incorporates the pairs of reference points into the figure of a clown face, which is placed on the drawing surface of the easel, and a hat, which is placed on a surface directly behind the easel. The clown face consists of a semi-circle, in which facial features have been drawn, that is printed on a card so that the straight edge of the semi-circle is coincidental to the top edge of the card. The term card is used herein with reference to size, shape and mobility generally associated with the term card, without intending any limitation to material from which it is constructed. The first pair of reference points is incorporated into the clown face so as to be the end points of the straight line of the semi-circle. Alignment of the portions of the figure is aided by a vertical line that bisects the semi-circle. The hat consists of an isosceles triangle with the point at the top. A plurality of reference points is incorporated into the hat so as to be the end points of any of a group of line segments that are printed as horizontal graduations in the triangle. The second pair of reference points may be chosen from these graduations. The horizontal graduations may be referenced numerically or by color. A vertical line bisects the triangle and aids in the alignment process. The base of the triangle is wide enough to allow the range of graduations, from which the second pair of reference points is chosen, to be large enough to accommodate all positioning requirements.

Proper positioning in order to record the viewing point of the eye is accomplished by aligning the two portions of the figure so that the hat appears to be resting directly above the clown face. When so positioned, each of the reference points of the first pair, which are coincidental to the end points of the straight line of the semi-circle, will appear to be contiguous with the corresponding end points of one of the graduations, so as to indicate a chosen second pair of reference points. The vertical line that bisects the triangle of the hat, and the vertical line that bisects the clown face, will appear to be a continuous line. This line may appear as a straight line, or it may appear as a line which bends at an angle at the point of intersection of the hat and the clown face.

While the user is free to use any process desired to return the eye to the recorded viewing point, the following is a non-limiting example that is intended to simplify the process. When using a preferred embodiment of the present invention, such as the clown face and the hat, the eye may be returned to the viewing point by use of the following steps: align the line segment which is the top of the clown face with the corresponding reference graduation in the hat; align the two lines which bisect the hat and the clown face respectively; move the eye toward or away from the easel until the hat is the same size as the clown face.

Misalignments indicating the eye is not at the recorded viewing point would include the hat appearing larger than the clown face, smaller than the clown face, or being at an angle to the clown face. The two vertical lines may also indicate the eye is not at the recorded viewing point by appearing to form an angle rather than a straight line or they may not line up at all.

A second example of this embodiment of the present invention incorporates the pairs of reference points into the figure of a kite. The top of the kite is a triangle identical to the triangle used as the hat, mentioned previously, and the second pair of reference points is likewise incorporated, as end points of horizontal graduations. The bottom of the kite is also an isosceles triangle, with the point at the bottom. The first pair of reference points is incorporated into the bottom portion of the kite figure as the end points of the base line segment of the triangle, which is at the top. A vertical line, which aids in the alignment process, bisects the triangle. Proper alignment is achieved when the two portions of the kite figure appear as a complete kite. When so positioned, each of the reference points of the first pair, which are coincidental to the end points of the line segment at the top of the triangle, will appear to be contiguous with the corresponding end points of one of the graduations, so as to indicate a chosen second pair of reference points.

Figure 2:
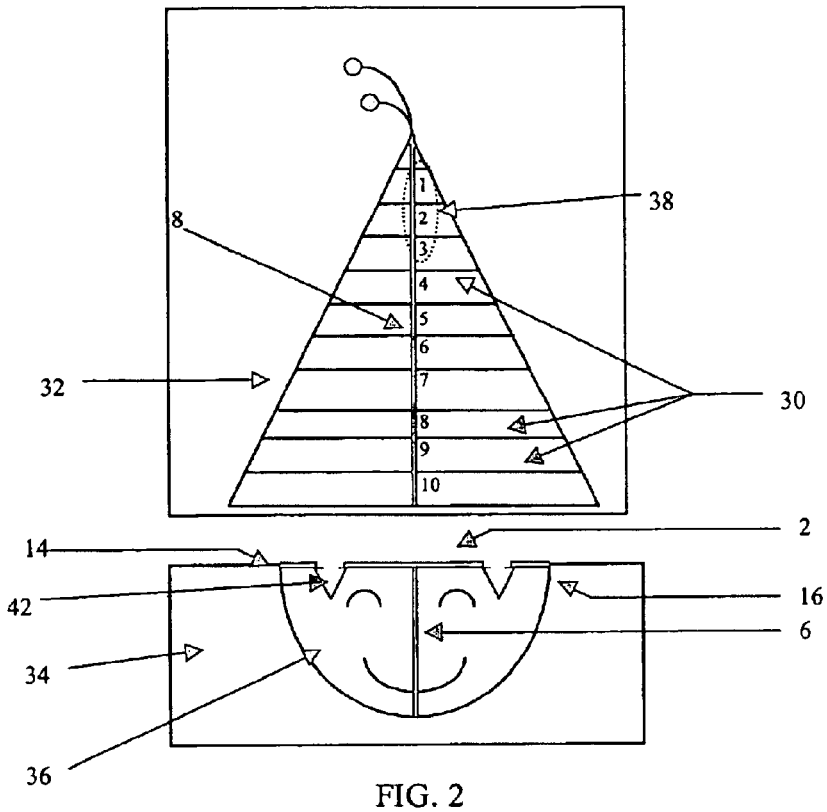
FIG. 2 is a schematic view of a preferred embodiment of the present invention that incorporates the basic elements of the present invention into a figure depicting a clown face and hat.

FIG. 2 shows a first example of a preferred embodiment of the present invention, which incorporates the pairs of reference points into the figure of a clown face 36, and a hat 32. Incorporated into the hat 32 are a group of line segments of varying length 30, from which to choose the line segment whose end points will be used as the second pair of reference points. These line segments of varying length appear as graduations and are identified by reference numerals 38. The vertical line 8 is perpendicular to, and bisects all of the line segments of varying length. Incorporated into the clown face are the first pair of reference points 14 and 16, which are the end point of the straight line 2 of the semi-circle. The vertical line 6 bisects the semi-circle. The clown face also includes two angular cut out portions 42, which aid in the positioning process by allowing the user to see if the chosen graduation is being totally or partially hidden by the card 34 on which the clown face is printed.

Figure 3:
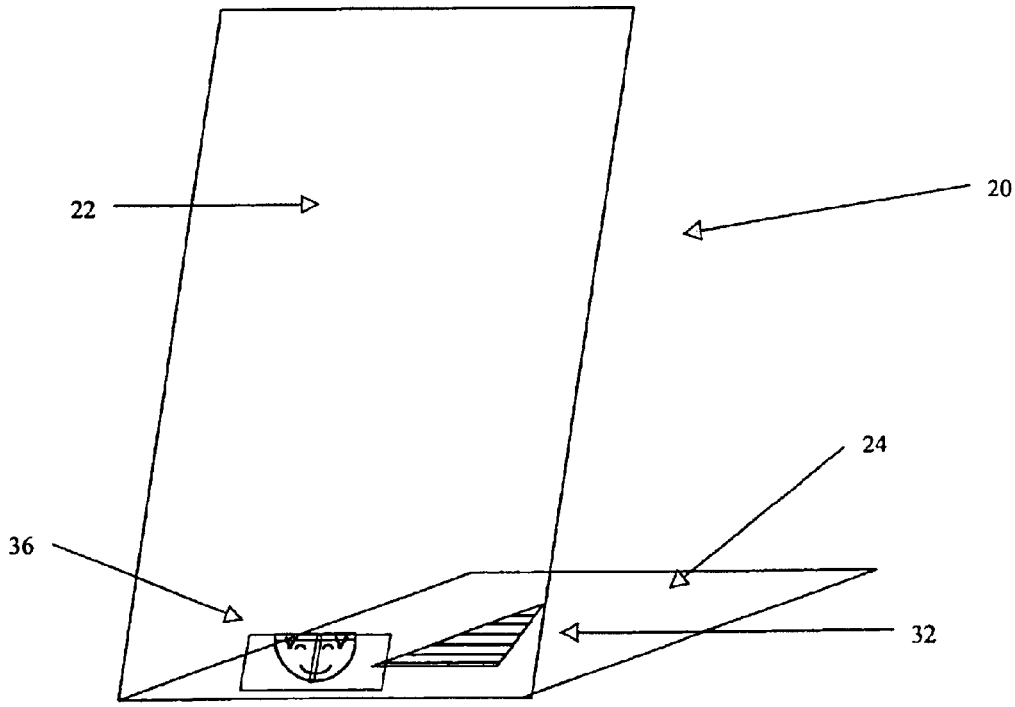
FIG. 3 is an isometric view of a preferred embodiment of the present invention depicting the figure of a clown face and hat showing the placement of the portions of the figure on a copy easel.

FIG. 3, shows a copy easel 20, with the clown face 36 positioned on the drawing surface 22 and the hat positioned on the base 32, directly behind the drawing surface.

Figure 4:
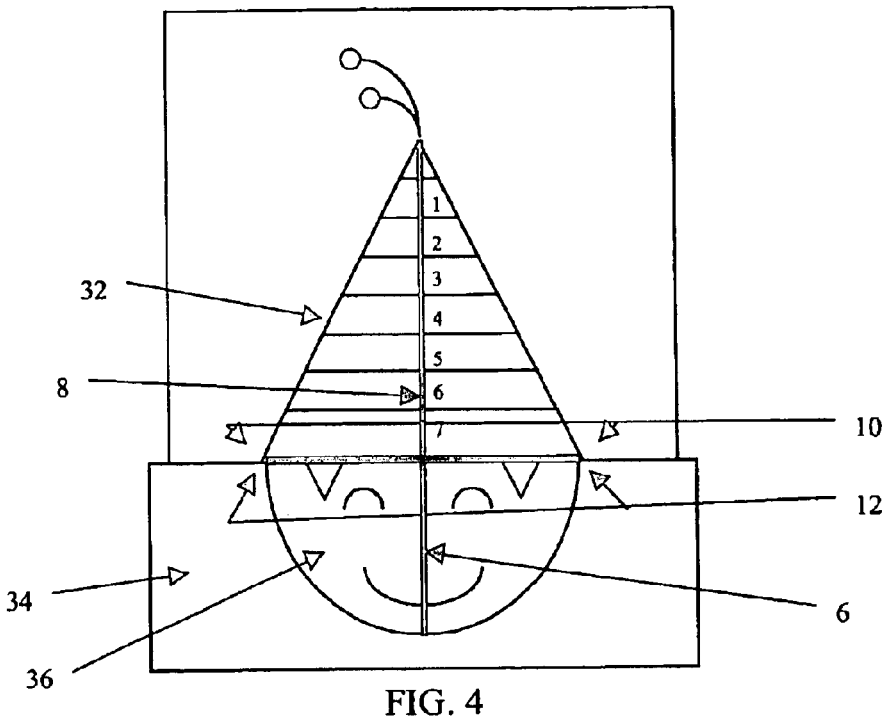
FIG. 4 is a schematic view of a preferred embodiment of the present invention depicting the figure of a clown face and hat showing proper alignment to record the viewing point.

FIG. 4, which is labeled similarly to FIG. 2, shows the proper alignment of the clown face 36 and hat 32, and the first pair 12 and the second pair 10 of reference points, in order to record the viewing point of the artist's eye, when no distortion of the subject is desired. This is also how the clown face and hat, and the reference points should appear when the eye is returned to the viewing point.

Figure 5:
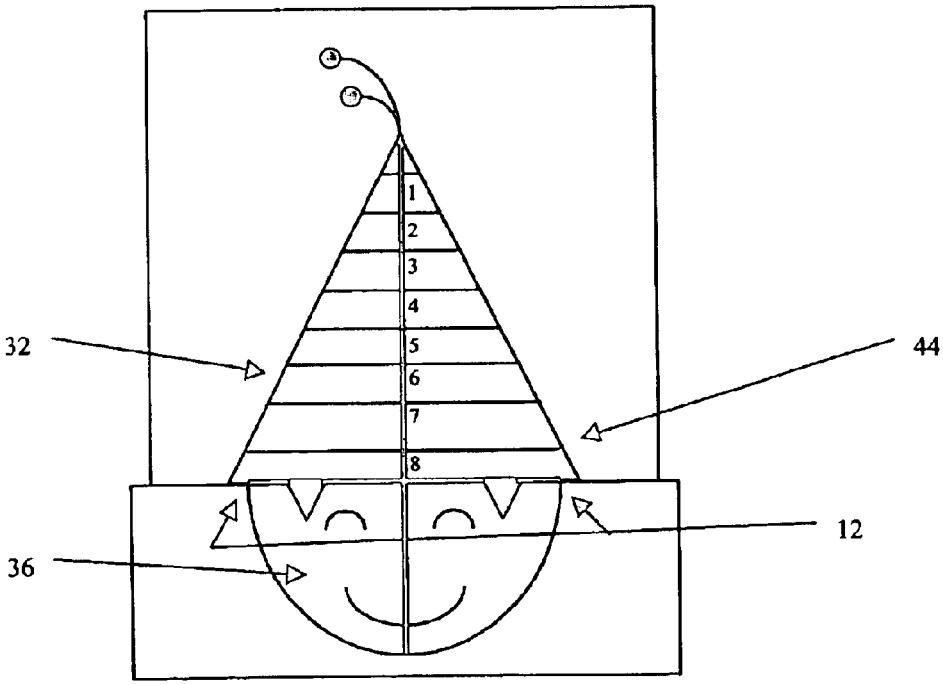
FIG. 5, and FIG. 6 are schematic views of the preferred embodiment of the present invention depicting the figure of a clown face and hat, showing two examples of misalignment.
Figure 6:
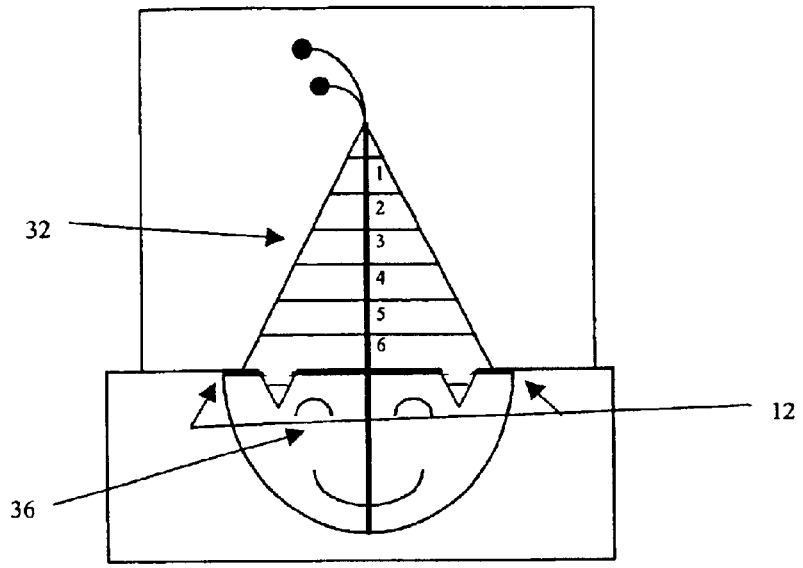

FIG. 5 and FIG. 6 show two examples of misalignment of the pairs of reference points and the figures, which indicate that the eye is no longer at the viewing point that was recorded by the present invention.

In FIG. 5 the reference points of the first pair of reference points 12 do not appear to be aligned with any chosen corresponding reference points. The misalignment is further indicated by the fact that the hat 32 appears to be larger than the clown face 36. Possible causes for this may be that the eye is higher than the recorded viewing point, or that the eye is closer to the figures than the recorded viewing point.

In FIG. 6 the reference points of the first pair of reference points 12 not appear to be aligned with any chosen corresponding reference points, and the hat 32 appears to be smaller than the clown face 36. Possible causes for this may be that the eye is lower than the recorded viewing point or that the eye is further away from the figures than the recorded viewing point.

Figure 7:
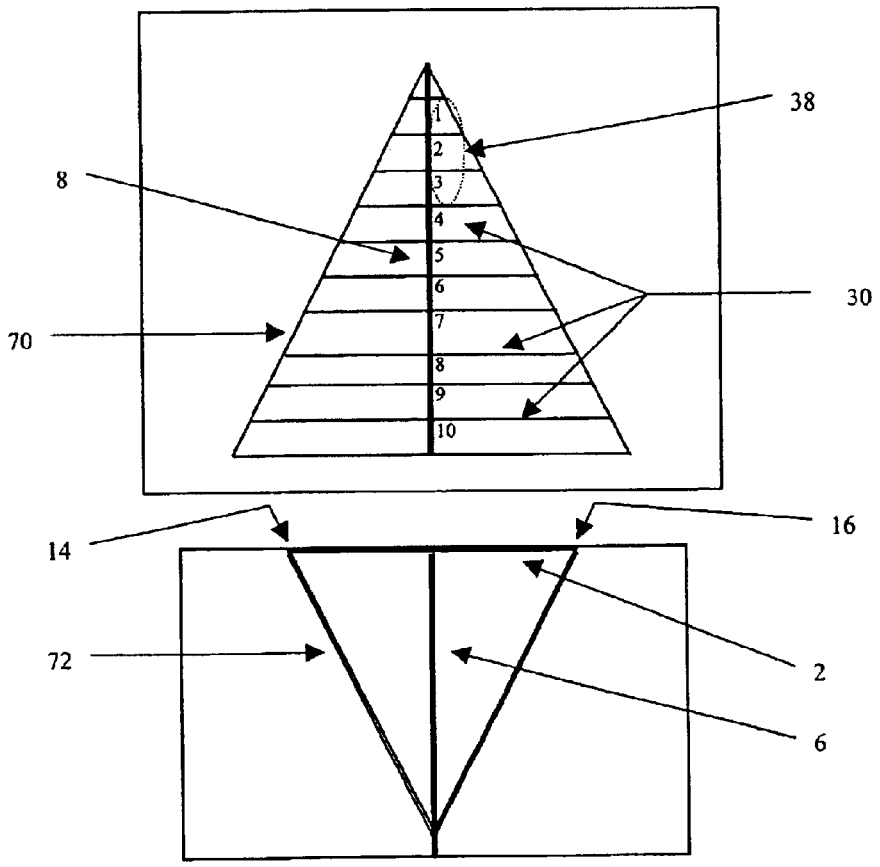
FIG. 7 is a schematic view of a preferred embodiment of the present invention that incorporates the basic elements of the present invention into a figure depicting a kite.
Figure 8:
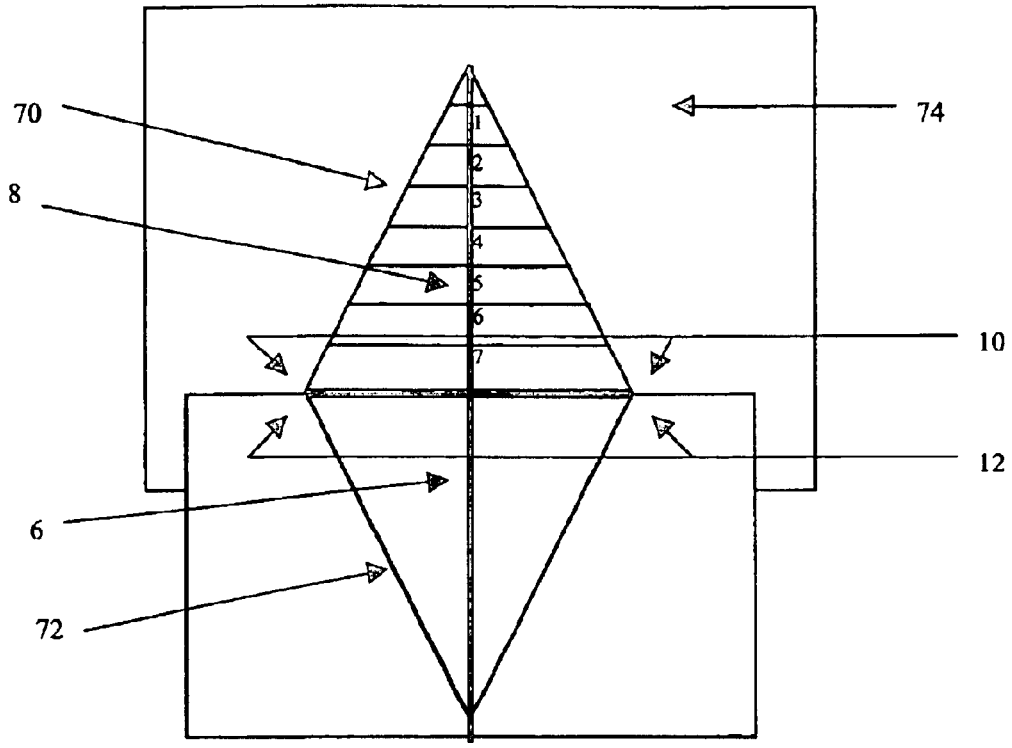
FIG. 8 is a schematic view of a preferred embodiment of the present invention depicting the figure of a kite, showing proper alignment to record the viewing point.

FIG. 7 shows a second example of the present invention, in which the pairs of reference points are incorporated into the figure of a kite. The top portion 70 of the kite is a triangle similar to the hat of FIG. 2, and is here similarly labeled. The bottom portion 72 of the kite is also a triangle. When the two portions of the kite are properly aligned, the reference points of the first pair of reference points 12 appear to be aligned with the reference points of the chosen second pair of reference points 10. The vertical line 8 and vertical line 6 appear to be a continuous line.

Figure 9:
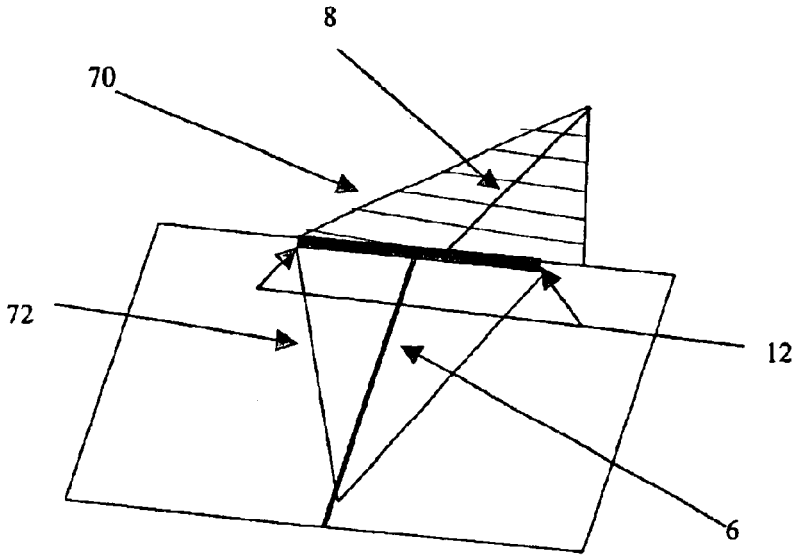
FIG. 9 is a schematic view of a preferred embodiment of the present invention depicting the figure of a kite, showing an example of misalignment.

FIG. 9 shows an example of misalignment wherein the reference points of the first pair of reference points 12 do not appear to be aligned with any chosen reference points of the second pair of reference points, nor do the vertical line 8 and the vertical line 6 appear to be a continuous line. A possible cause of this misalignment may be that the eye is to one side of the recorded viewing point. In this case, the eye is to the right of the recorded viewing point.

Figure 10:
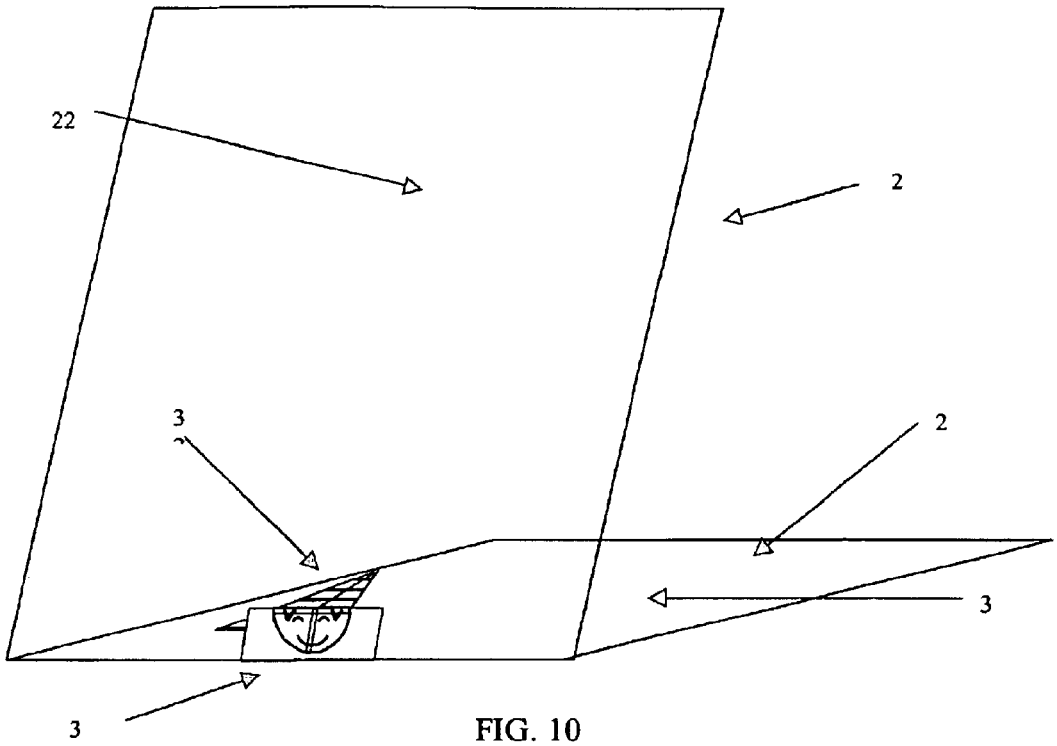
FIG. 10 is an isometric view of a preferred embodiment of the present invention showing proper placement of the portions of the figure when a degree of distortion is desired in the copy drawing.

FIG. 10 shows a possible alignment of the portions of a preferred embodiment of the present invention in a case where the artist chooses to make a copy drawing with a degree of distortion. In this example the hat 32 appears to be resting on the clown face 36 and appears to be the correct size, however, the hat appears to be tilting to the side, rather than sitting straight, and the line 8 that bisects the hat and the line 6 that bisects the clown face appear as a line which bends at the line of superimposition of the hat and the clown face. It should be noted that the degree of angle of the bend is an indication of the amount of distortion that will be produced in the copy drawing.

A second preferred embodiment of the present invention incorporates the second pair of reference points into a device that includes a mechanism that varies the distance between two reference points. This enables the device to designate a pair of reference points that are separated by a selected distance.

One possible way of achieving this is to move a line segment that appears to be horizontal between two convergent line segments, which appear to be vertical. Reference points may be designated by points on the vertical line segments that are used as end points for the horizontal line segment. After the first pair of reference points is positioned on the drawing surface of the easel, a second pair of reference points would be designated, thus aligning the pairs of reference points and recording the viewing point.

Figure 11:
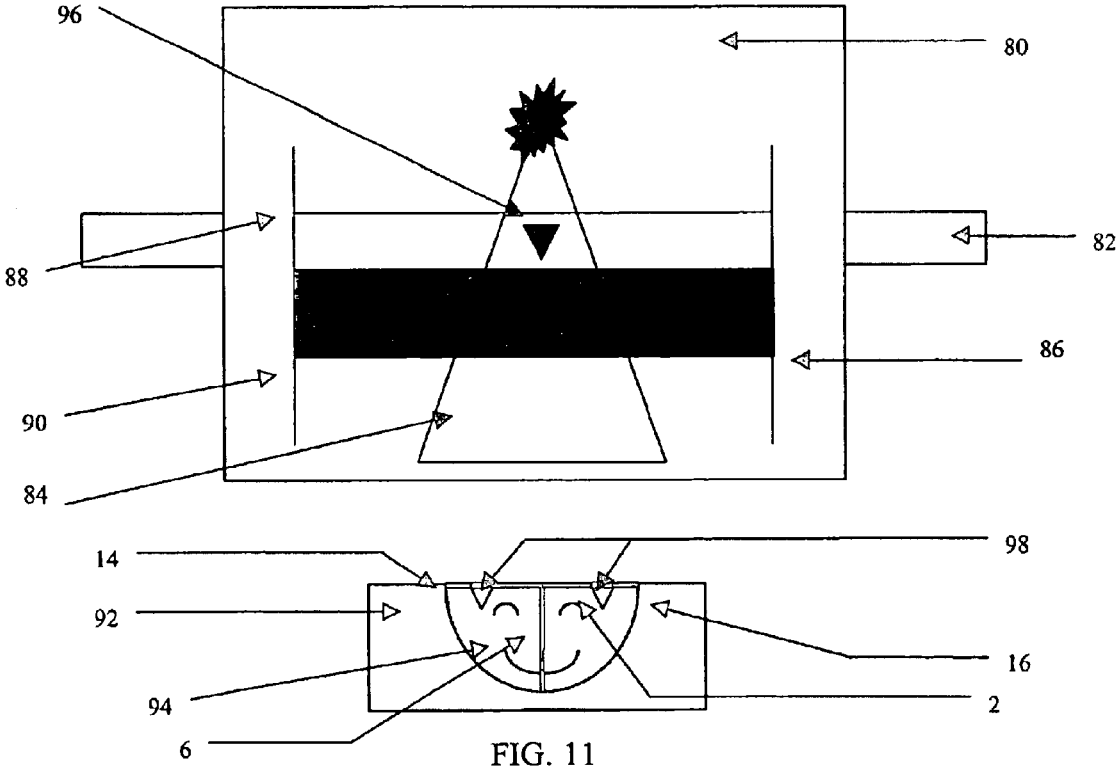
FIG. 11 is a schematic view of a preferred embodiment of the present invention that incorporates the basic elements of the present invention into a device that designates a plurality of reference points that are separated by varying distances.

FIG. 11 shows a preferred embodiment of the present invention that utilizes a device that includes a mechanism that varies the distance between two reference points, enabling the device to designate a pair of reference points that are separated by a selected distance. One way of implementing such a device would be as follows. A device consisting of a card 80, into which two vertical slits 86 and 88 have been cut, and onto which a triangular hat 84 has been drawn. A transparent crossbar 82 passes horizontally over the card and through the slits, coming out from under the card at both sides. An opaque bar 90, printed on the crossbar, serves as an indicator for the second set of reference points. Incorporated into a clown face 94, which is printed on a card 92, are the first pair of reference points 14 and 16, which are the end point of the straight line 2 of the semi-circle. There are two "v" shaped notches 98 cut out of the top edge of the card, and a vertical line 96, which bisects the semi-circle. An inverted triangle 96 located above the opaque bar 90 is also printed on the crossbar. These notches and the inverted triangle aid in the alignment process.

Figure 12:
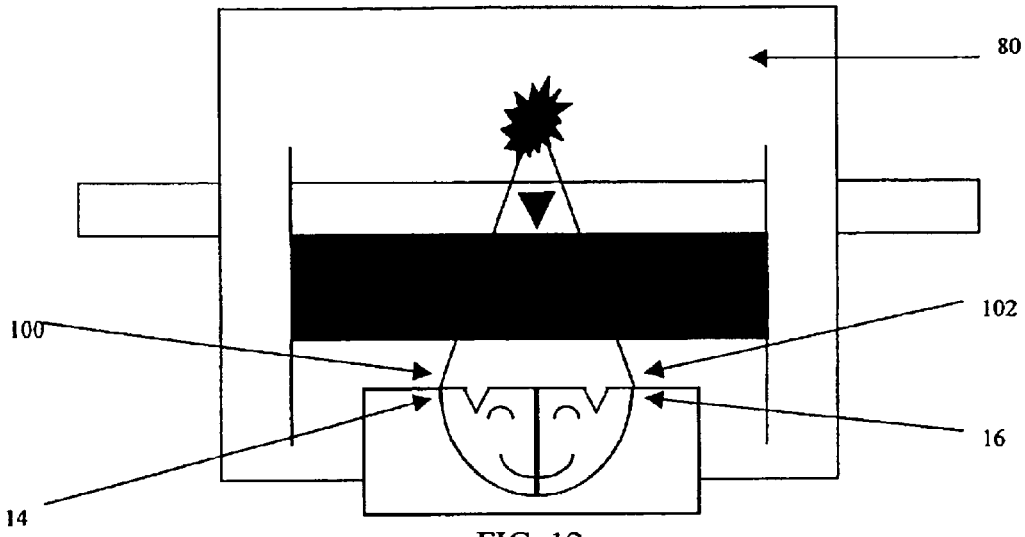
FIG. 12 and FIG. 13 are schematic views showing the operation of a preferred embodiment of the present invention that incorporates a device that designates a plurality of reference points that are separated by varying distances.
Figure 13:
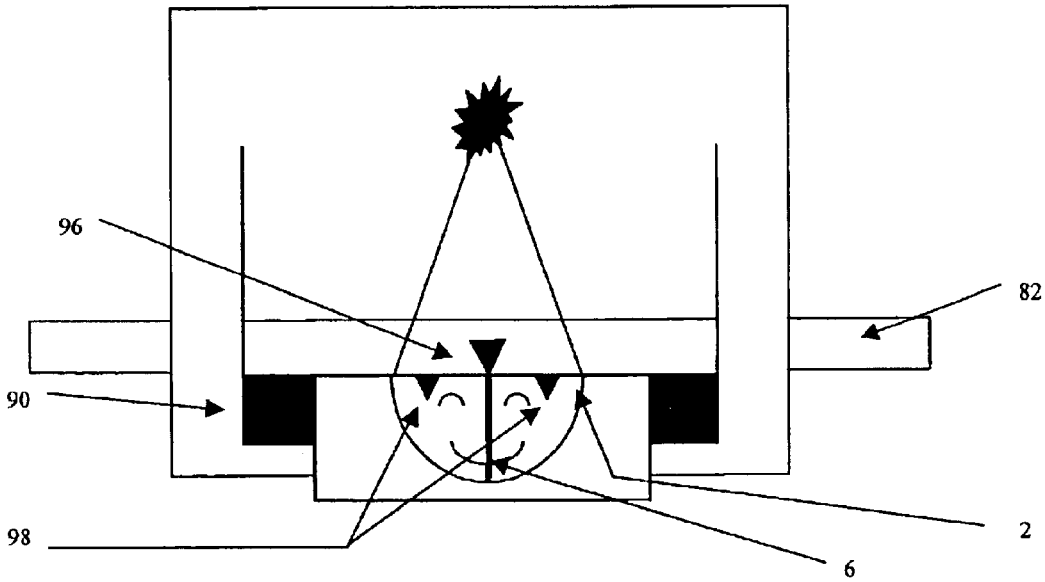

FIG. 12 and FIG. 13 show the process for proper alignment of the clown face, hat, and brim in order to record the viewing point of the artist's eye.

In FIG. 12 the card 92, which has the clown face printed on it, is placed on the drawing surface of the easel. The card 80 with the hat printed on it is positioned behind the drawing surface of the easel so that the reference points 14 and 16 of the of the first pair of reference points appear coincidental to points 100 and 102 on the line segments that form the sides of the triangle of the hat.

In FIG. 13, the crossbar is repositioned so that the top edge of the opaque bar 90 appears to be contiguous with the top edge 2 of the clown face and disappears behind the card. Note that the two notches 98 are now colored and the inverted triangle 96 appears to be resting directly on the top of the line 6 which bisects the clown face.

Figure 14:
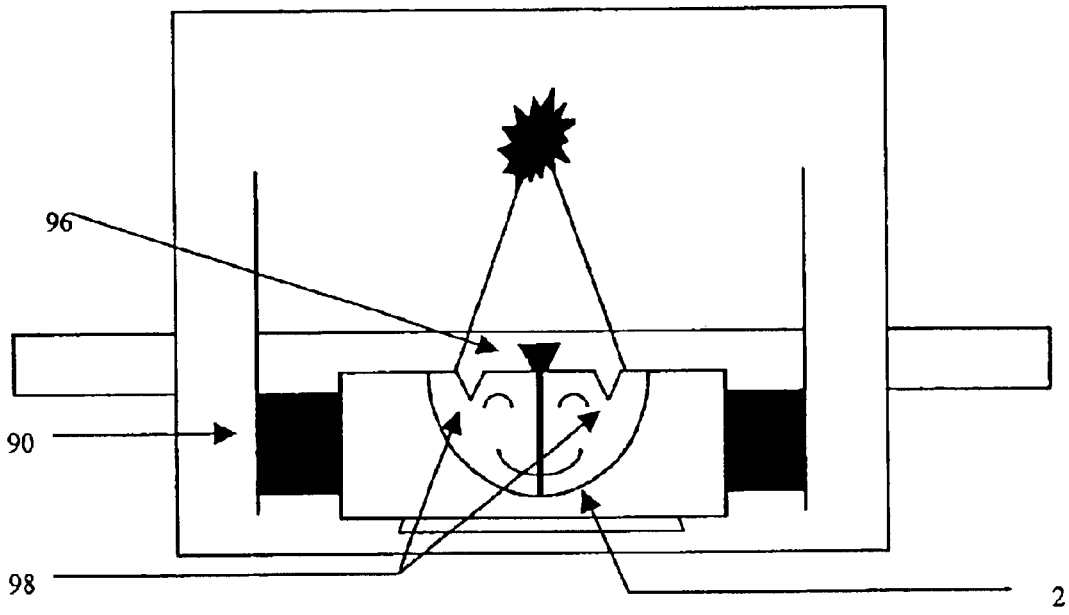
FIG. 14 and FIG. 15 are schematic views of a preferred embodiment of the present invention that incorporates a device that designates a plurality of reference points that are separated by varying distances, showing examples of misalignment.
Figure 15:
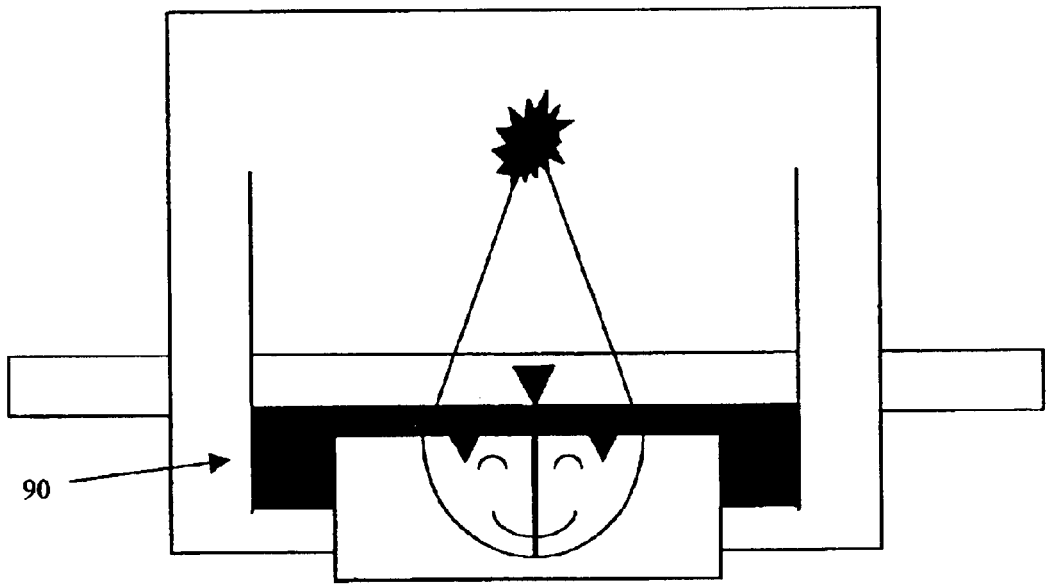

FIG. 14 and FIG. 15 show two examples of misalignment of the figure, which indicate that the eye is no longer at the viewing point that was recorded by the present invention.

In FIG. 14, the opaque bar 90 appears to be lower than the top edge of the card with the clown face. Further, the notches 98 are no longer colored and part of the inverted triangle is hidden behind the clown face. This could be caused by the eye being lower than the recorded viewing point.

In FIG. 15, the opaque bar 90 appears to be higher than to the top edge of the clown face. This could be caused by the eye being higher than the recorded viewing point.

Figure 16:
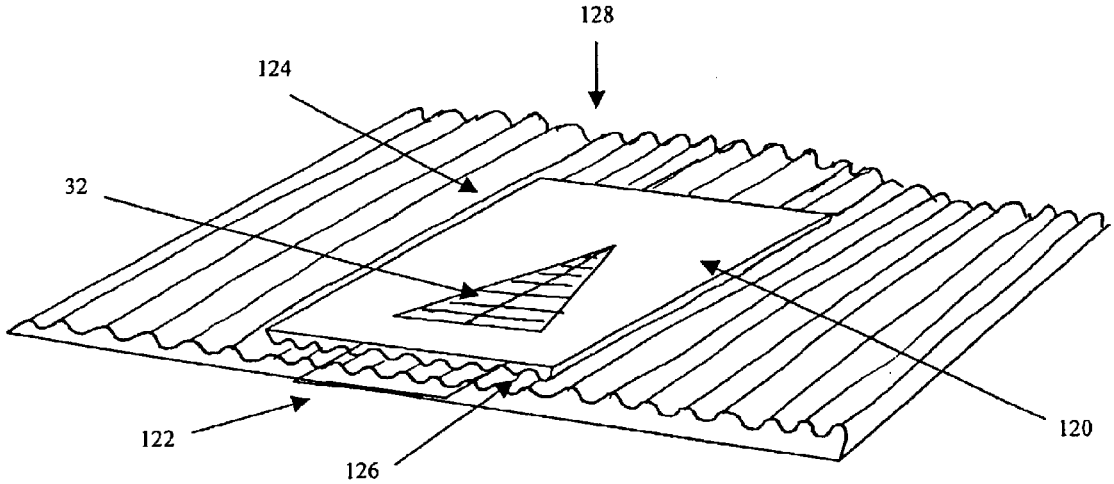
FIG. 16 is an isometric view of that portion of a preferred embodiment of the present invention that restricts the lateral movement of the second pair of reference points.

FIG. 16 show the hat portion 32, of the clown face with a hat figure of the present invention, printed on an alignment piece. The alignment piece consists of a card 124 that is made of material that has a smooth printable top surface 120 and a corrugated bottom surface 126. A second card 122 has a similarly corrugated top surface 128. Preferably, the second card is large enough that, when fixed to the surface of the base directly behind the drawing surface, a majority of the width of the base is covered so as to supply a corrugated surface. The first card, with the hat printed on it, is positioned on the corrugated surface. When so positioned, the alignment piece 124 is freely moveable forward and backward relative to the easel. This allows for the adjustment of the relative position of the hat with respect to the clown face, while maintaining the orientation of the two portions of the figure.

Figure 17:
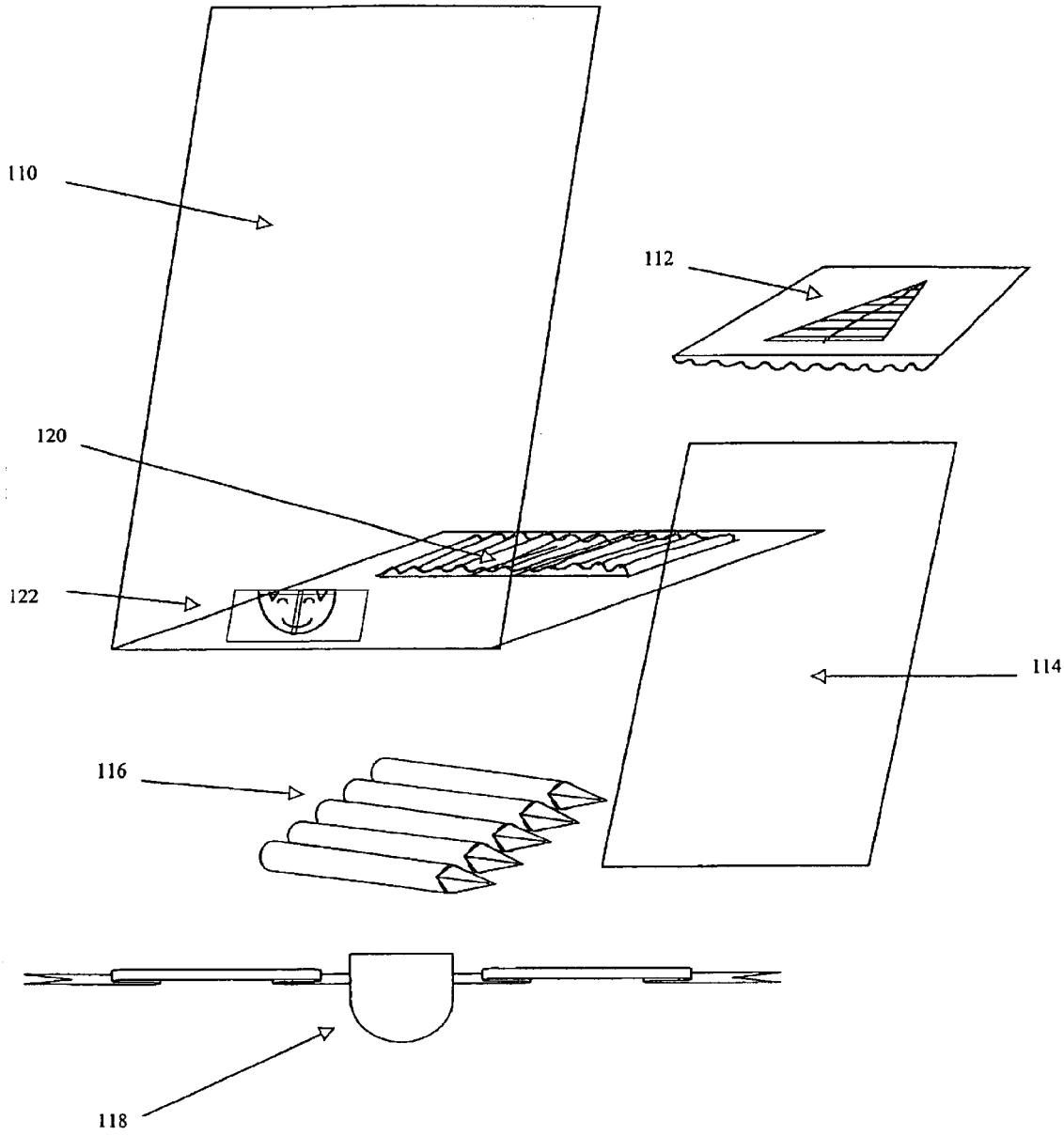
FIG. 17 is an isometric view of a first preferred embodiment of a copy drawing system of the present invention.
Figure 18A:
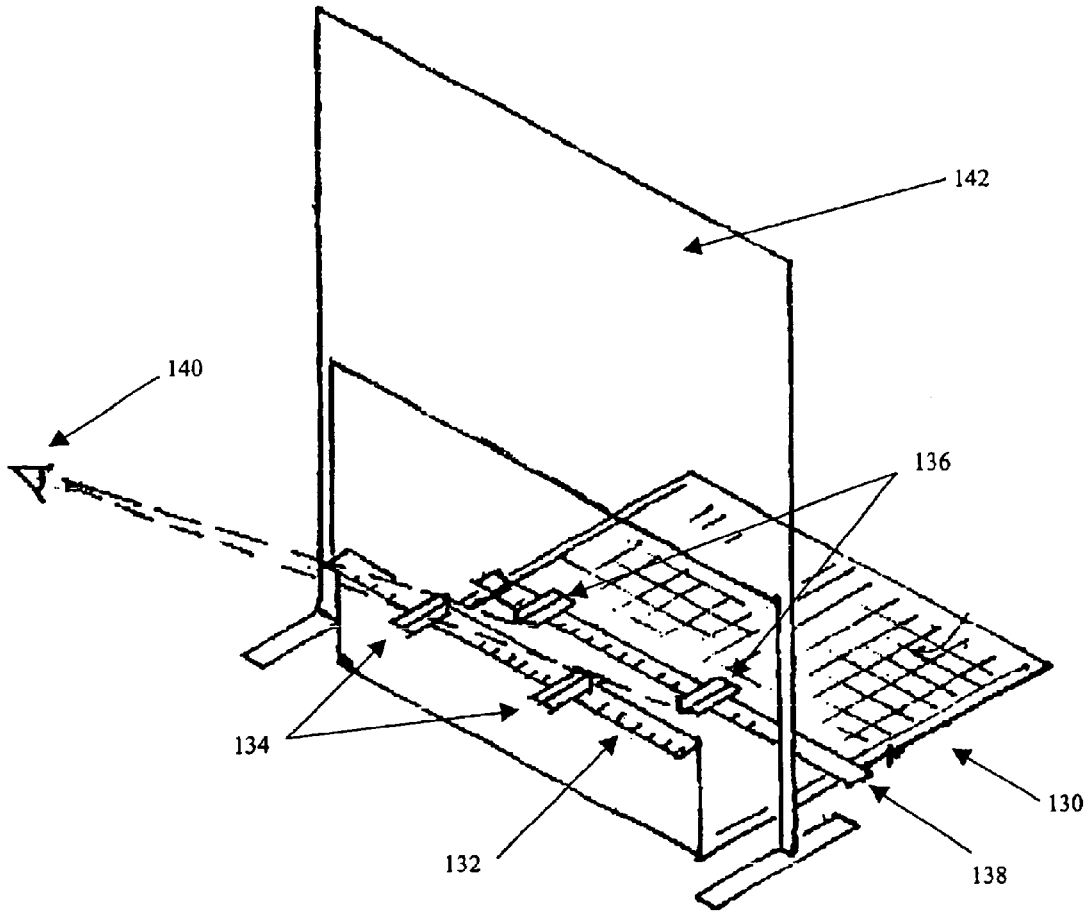
FIG. 18*a* is an isometric view of a preferred embodiment of the present invention that is deployed below a copy easel.
Figure 18B:
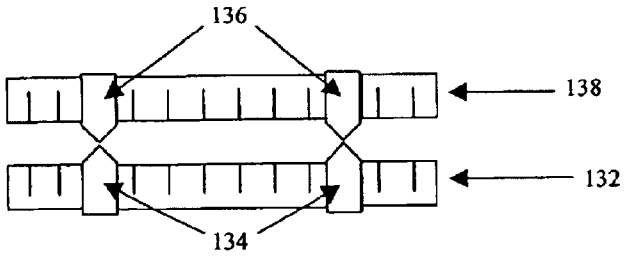
FIG. 18*b* is a schematic detail of a properly aligned reference-point designation apparatus of the embodiment of FIG. 18*a;*

FIG. 17 shows all of the components of a first preferred embodiment of a system of the present invention for making a copy drawing of a subject, which includes: a one piece copy easel 110; transparent drawing medium 114; a device for covering an eye 118; drawing utensils 116; a figure 122, which designates the first pair of reference points, fixed to the drawing surface of the easel; the alignment piece 112, on which is printed the figure that designates the second pair of reference points; and the mechanism 120 that restricts the movement of the alignment piece to a preferred direction of alignment.

Yet, a third preferred embodiment of the present invention uses a separate apparatus for designation of the reference points. The example shown in FIG. 18*a* has a base 130 that is deployed below a copy easel 142. The base is marked with a grid to aid in the positioning of a movable graduated rule 138 upon which two pointers 136 are slidably attached. Located at the end of the base closest to the user is an elevated graduated track 132 upon which two corresponding pointers 134 are slidably attached. To record the position of the viewing point 140, the graduated rule 138 is placed on the grid of the base. The pointers are then repositioned so that the points of the corresponding pointers, one pointer on the graduated rule and one pointer on the elevated track, appear to be pointing at the same point. The other corresponding pointers are similarly repositioned. When properly aligned, the pointers will appear from the viewing point like the detail shown in FIG. 18*b*.

Figure 19A:
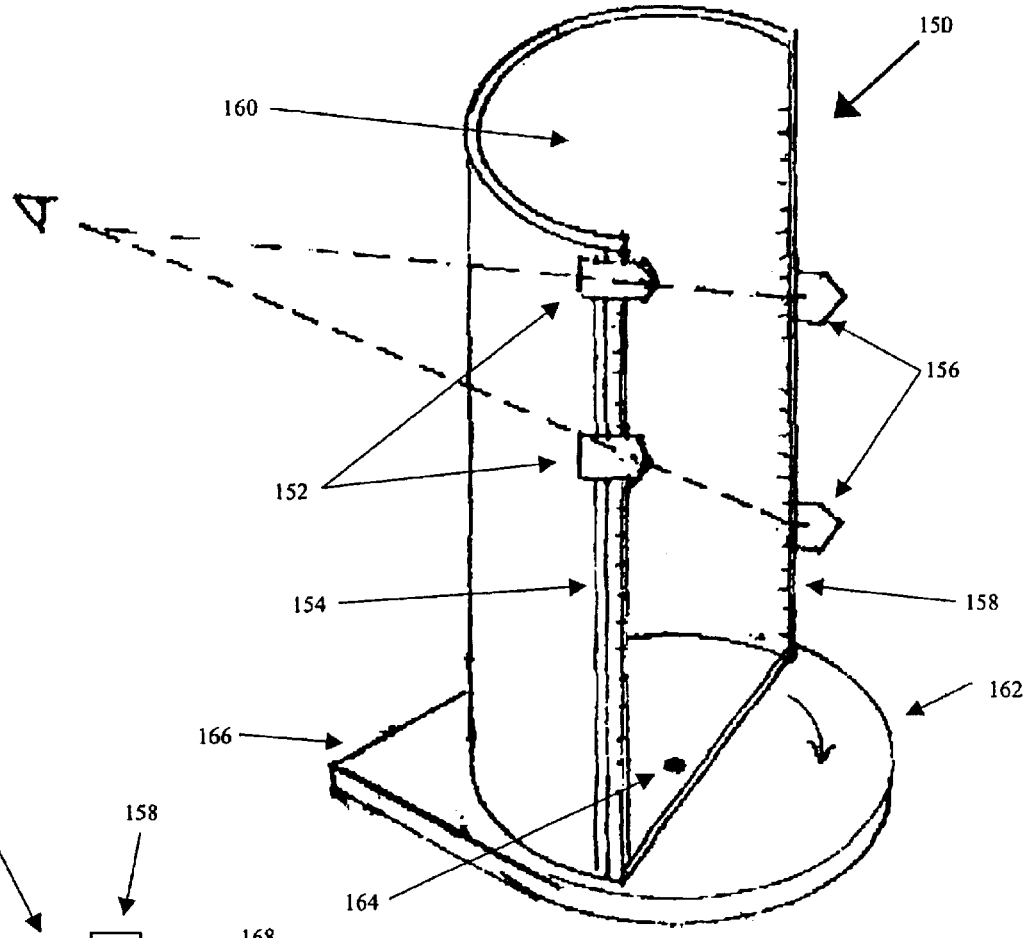
FIG. 19*a* is an isometric view of a preferred embodiment of the present invention that is deployable in proximity of a copy easel.
Figure 19B:
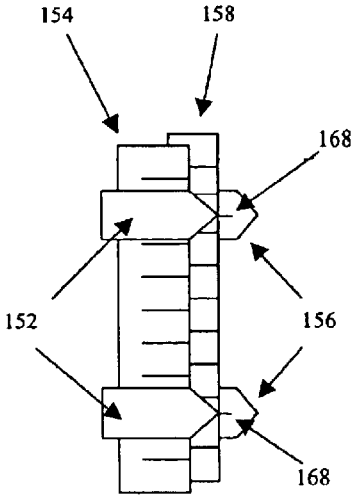
FIG. 19*b* is a schematic detail of the a properly aligned reference-point designation apparatus of the embodiment of FIG. 19*a;*

The apparatus of a fourth preferred embodiment shown in FIG. 19*a*, generally referred to as 150, may be deployed anywhere in the vicinity of the copy easel that the user finds appropriate. The reference points are designated by use of two pair of corresponding pointers 152 and 156. Each pair of pointers is slidably attached to one of two graduated rules 154 and 158 that are configured as part of a frame, such that the pointer edge of each of the two rules are parallel and are co-planer. It should be noted that while the graduated rules must be co-planer, they need not be parallel. The frame 160 shown here is configured as a cut-away cylinder with ruled straight edges. It will be appreciated that the shape of the frame may vary. For convenience and ease of alignment, the frame is rotatably attached to a base 162 by a shaft 164, thereby allowing the frame to be rotated in order to bring the plane of the apparatus in alignment with the line of sight from the viewing point. Recording of the viewing point using this embodiment is accomplished by first placing the recording apparatus in an appropriate position, preferably near the copy easel. Then, one or more of the pointers is repositioned until the points of the two pointers on the rule closest to the user are properly aligned with the pointers on the other rule. A non-limiting example of proper alignment is shown in FIG. 19*b*. Here the points of the pointers closest to the user are pointing at the point of intersection of the edge of the corresponding rule and perpendicular lines drawn on the corresponding pointers. The principles of the present invention are unaffected by the attitude of the plane in which the four reference points are located. The base shown here is designed so as to allow use of the apparatus in either a horizontal position as shown or a vertical position by way of the shape of the base in the area 166.

Figure 20A:
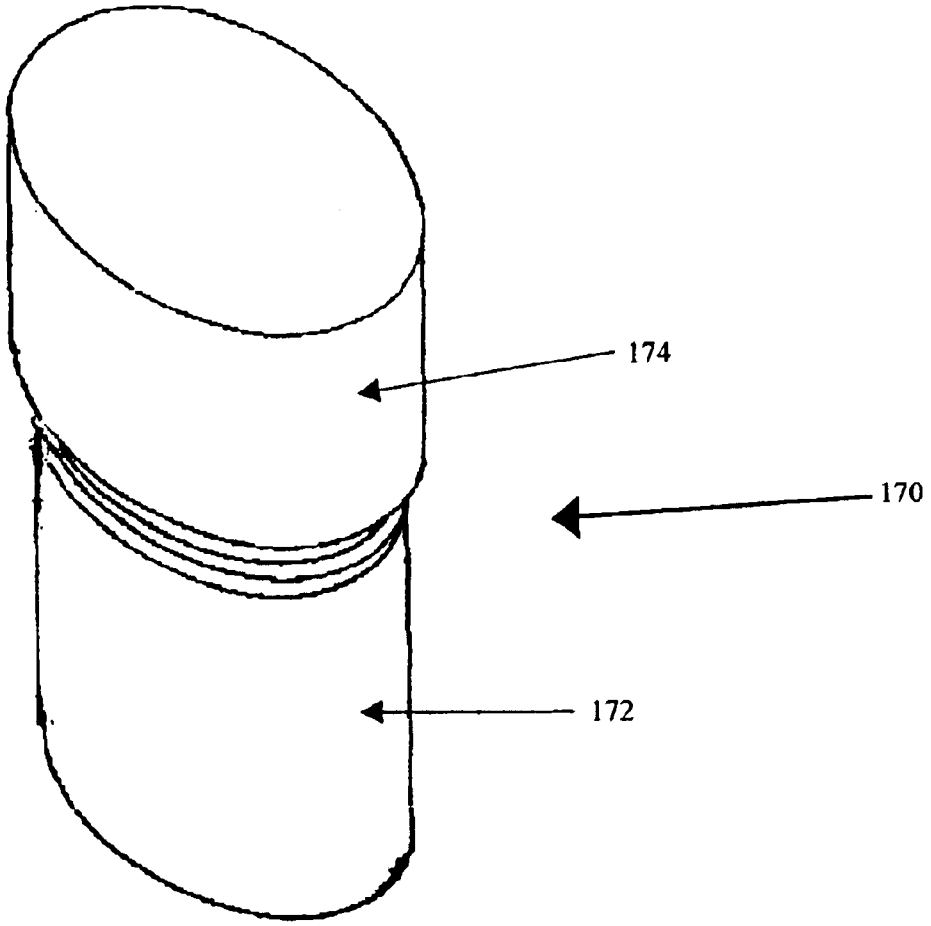
FIG. 20*a* is an isometric view of a head support for use with any of the preferred embodiments of the present invention.
Figure 20B:
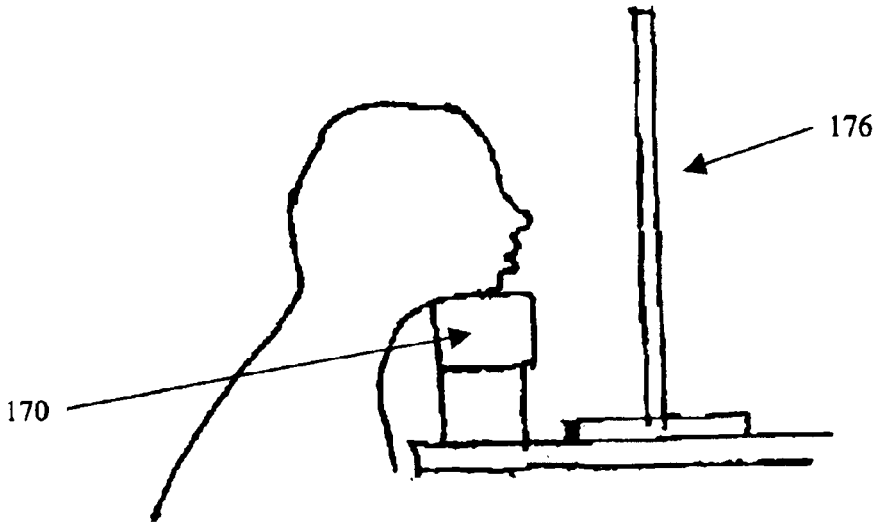
FIG. 20*b* is a schematic view of the head support of FIG. 20*a* in use.

To aid with the support of the head of the user during prolonged drawing sessions, a head support such as the non-limiting example of FIG. 20*a*, may be used. The adjustable head support 170 has a base section 172 and a support section 174. The height of the support section is adjustable. An example of the head support in use is shown in FIG. 20*b*.

Figure 21:
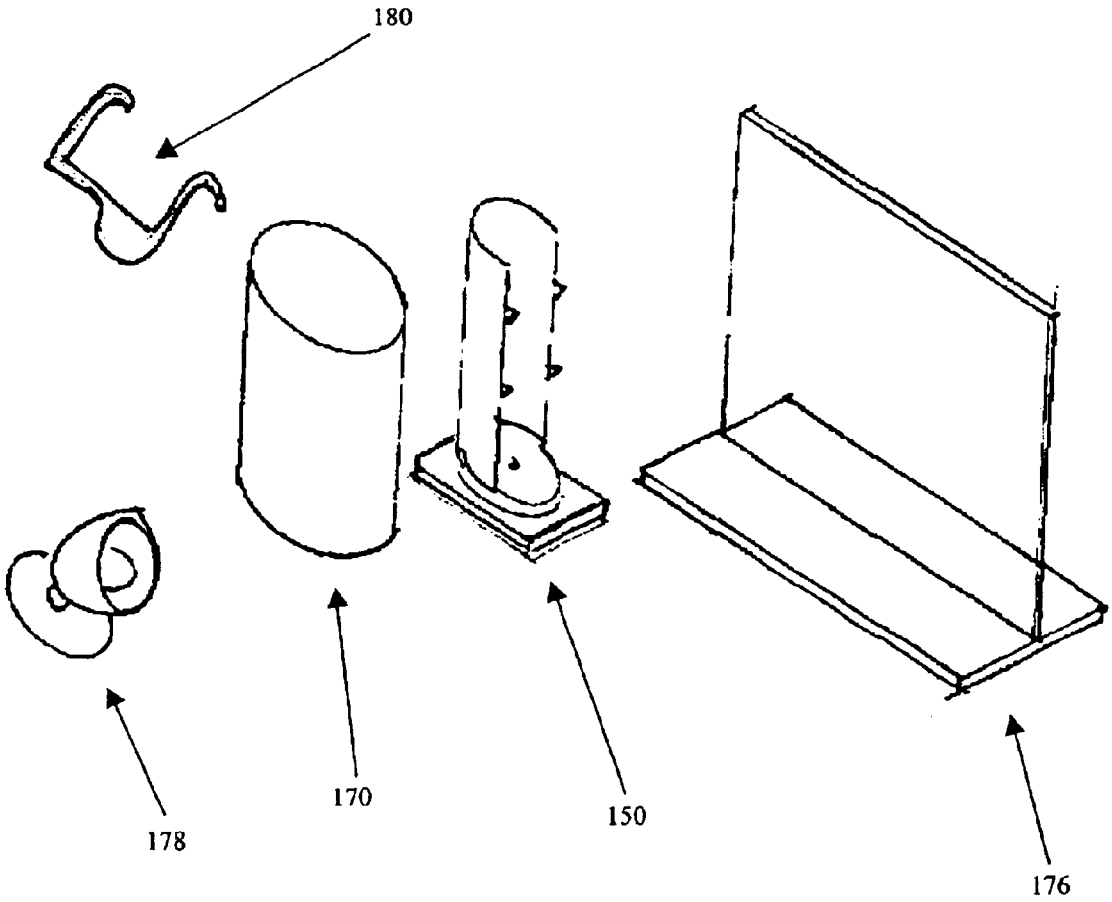
FIG. 21 is an isometric view of a second preferred embodiment of a copy drawing system of the present invention.

FIG. 21 shows all of the components of a second preferred embodiment of a system of the present invention for making a copy drawing of a subject, which includes: a copy easel 176; a viewing point recording apparatus of FIG. 19*a* 150; a head support 170; an eye covering 180; an a light for illuminating the subject 178.

FIG. 22*a* shows a preferred embodiment of the present invention that consists of a frame 220 with a flat support surface 222 from which a front graphic surface 208 extend below and a rear upright surface 214 extends above. The frame is supported by a stand 216 that allows horizontal rotation of the frame about pin 218. The entire frame may be positioned as necessary, thus allowing vertical rotation of the frame. The first pair of reference points 204 and the second pair of reference points 206 are incorporated into complimentary portions 200 and 202 of a graphic form such that when aligned properly they appear to from a single complete graphic form (see FIG. 22*b*).

The portion of the graphic form 200 that includes the first pair of reference points 204 is placed on the front graphic surface so that the reference points are located on the edge where the front graphic surface connects to the flat support surface. The portion of the graphic form 202 that includes the second pair of reference points 206 is placed on a separate card 210 with the reference points located on an edge of the card, the card is deployed so that the edge with the second pair of reference points is resting on the support surface 222 and the card is held in a position perpendicular to the support surface by the rear upright surface 214. Thus positioned, all four of the reference points are located in the same plane. The alignment process of this embodiment includes positioning the frame and rotating it horizontally so as to bring the plane of the four reference points into alignment with the plane form by the second pair of reference points and the viewing point. Once this is accomplished, the card 210 upon which the second pair of reference points is placed is repositioned vertically to bring the two pair of reference points into alignment. FIG. 22*b* gives an example of the proper alignment for a graphic form of a circle. FIG. 22*c* give one example of misalignment of the same graphic form of a circle.

Figure 23A:
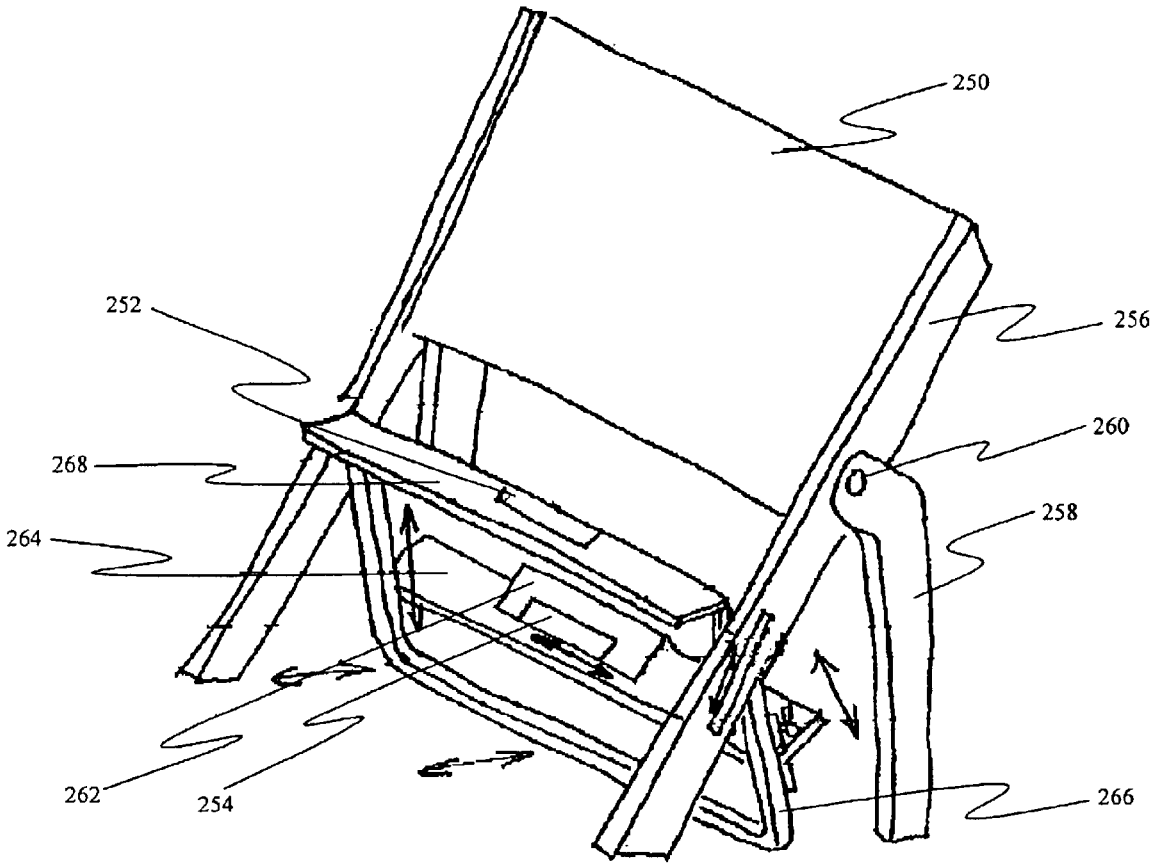
FIG. 23*a* is an isometric view of a preferred embodiment of the present invention that is adjustably attached to a foldable drawing easel.

FIG. 23*a* shows a fifth preferred embodiment of the present invention. Here, the transparent drawing surface 250 is mounted in a foldable easel system. The easel frame is supported by two legs formed by the bottom ends of the easel frame 256 and foldable legs 258, which rotate about pins 260. This allows the legs to be rotated substantially parallel to the easel frame for storage and transportation. The graphic forms of this embodiment are placed of an adjustable frame element 266. A first graphic form 252, by non-limiting example shown here as the bottom half of a rectangle, is affixed to a downwardly projecting extension 268 located in the front of the frame element. A second graphic form 254 is affixed to a reference component 262, by non-limiting example shown here as the top half of a rectangle, that is slidably mounted on a raised track 264 that projects upwardly from the rear of the frame element.

Figure 23B:
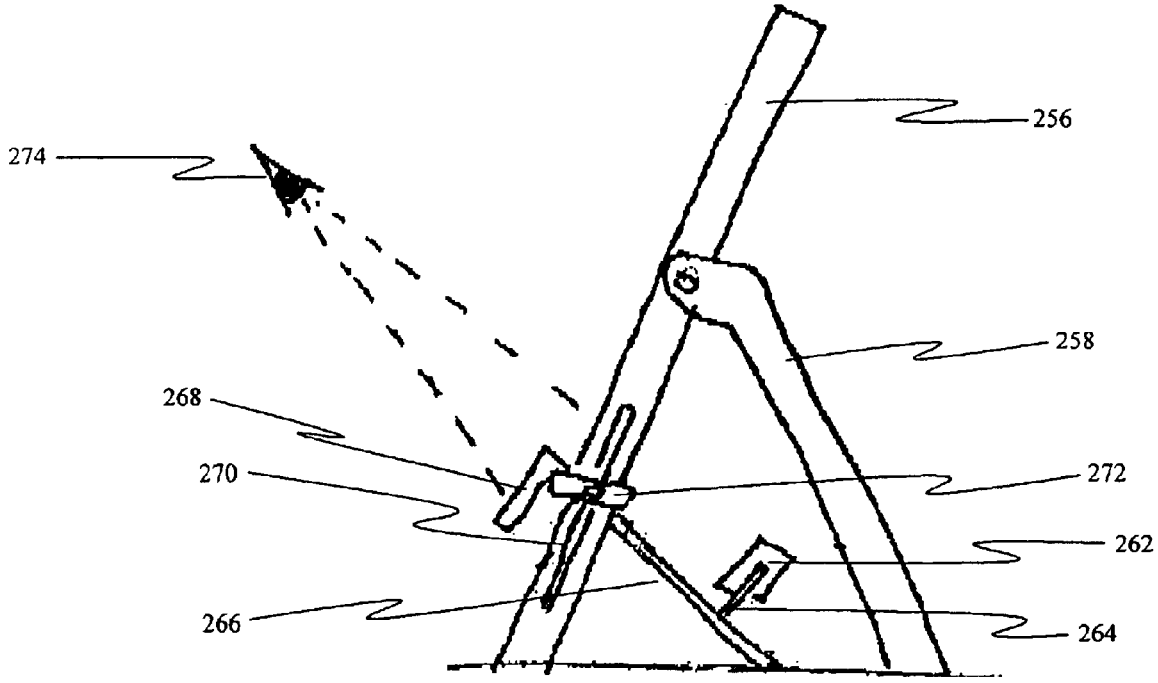
FIG. 23*b* is a side view of the preferred embodiment of FIG. 23*a*.
Figure 23C:
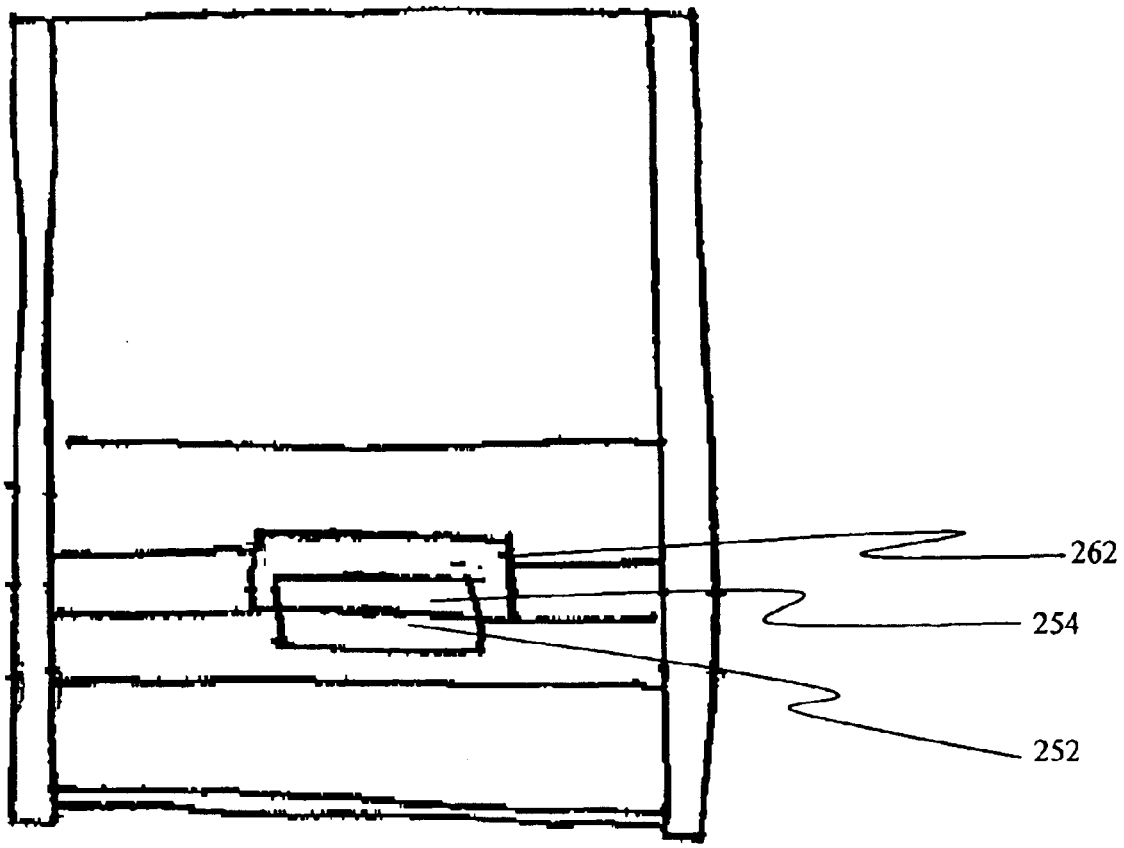
FIG. 23*c* is a front view of the preferred embodiment of FIG. 23*a* showing the proper alignment of the graphic forms of the present invention.

The side view of FIG. 23*b* includes the eye of the viewer. The viewing point is recorded by a combination of sliding the reference component 262 along the raise track 264, and adjusting the height of frame element 266 until the two graphic forms are aligned as shown in FIG. 23*c*. The frame element 266 is made adjustable by loosening the thumbscrew 272 and sliding the frame element up or down in the adjusting slot 270. The adjustability of the frame element also allows the frame element to be rotated to a position between and parallel to the easel frame 256 for storage and transportation.

It will be appreciated that the above descriptions are intended only to serve as examples, and that many other embodiments are possible within the spirit and the scope of the present invention.

What is claimed is:

1. A method for recording a point in space, which is to be used as a viewing point from which an eye will view a subject, said view being monocular, so as to render visual perception two-dimensional, the viewing point being recorded in such a way as to allow the eye to be returned to the viewing point if the position of the eye is changed, the method comprising:

(a) designating each reference point, of a first pair of reference points, by use of at least a first graphic form, said first graphic form being included in a first surface of an apparatus for designating reference points;

(b) designating each reference point, of a second pair of reference points, by use of at least a second graphic form, such that said first pair of reference points is located between said second pair of reference points and the eye, said second graphic form being included in a second surface of said apparatus for designating reference points, wherein said first surface and said second surface are structurally connected to each other; and (c) positioning said graphic forms such that, when seen from the viewing point, each of said reference points of said first pair of reference points appears to be superimposed on said reference points of said second pair of reference points.

2. The method of claim 1, further comprising returning the eye to the viewing point by changing the position of the eye until said at least a first graphic form designating said reference points of said first pair of reference points is aligned with said at least a second graphic form designating said reference points of said second pair of reference points.

3. The method of claim 1, wherein said designation of said first pair of reference points is by placement of said at least a first graphic form, of said first pair of reference points, on a transparent drawing surface of a copy easel.

4. The method of claim 3, wherein said designation of said second pair of reference points is by placement of said at least a second graphic form, of said second pair of reference points, on a surface behind said copy easel.

5. The method of claim 4, wherein an alignment is accomplished by said positioning being performed on said at least a second graphic form of said second pair of reference points.

6. The method of claim 5, further comprising the restriction of the rotation of said at least a second graphic form of said second pair of reference points during transitional movement that occurs during said positioning, said restriction being by use of a mechanical element.

7. The method of claim 5, wherein said second pair of reference points is designated as end points of a line segment.

8. The method of claim 7, wherein said line segment is chosen from a group of line segments of varying lengths.

9. The method of claim 8, wherein said line segments are distinguished such that individual line segments are identifiable.

10. The method of claim 1, wherein said pairs of reference points are incorporated into complimentary portions of a figure, said figure having a normal appearance such that proper alignment of said pairs of reference points will further result in the proper alignment of said portions of said figure so as to make said figure appear to be complete and normal.

11. The method of claim 1, wherein said reference points of said second pair of reference points are designated by a device that includes a mechanism that varies the distance between two reference points, enabling the device to designate a pair of reference points that are separated by a selected distance.

12. The method of claim 1, wherein said at least a first graphic form includes implementation as at least two graphic forms, of said first pair of reference points.

13. The method of claim 12, wherein said at least a second graphic form includes implementation as at least two graphic forms, of said second pair of reference points.

14. The method of claim 13, wherein said designation of said first pair of reference points includes placement of said graphic forms, of said first pair of reference points, on a track, said track being deployed below the transparent drawing surface of a copy easel, said track being elevated above the surface upon which it is supported, said graphic forms, of said first pair of reference points, including pointers slidably attached to said track.

15. The method of claim 14, wherein said designation of said second pair of reference points includes placement of said graphic forms, of said second pair of reference points, on a graduated rule deployed on a surface behind said copy easel, said graphic forms, of said second pair of reference points, including pointers slidably attached to said graduated rule.

16. The method of claim 15, wherein an alignment includes said positioning being performed on at least one of said pointers of said reference points.

17. The method of claim 13, wherein said designation of said first pair of reference points includes placement of said graphic forms, of said first pair of reference points, on a first graduated track, said first graduated track having a first edge, said first track being deployed on a movable frame, said graphic forms, of said first pair of reference points, including pointers slidably attached to said first graduated track.

18. The method of claim 17, wherein said designation of said second pair of reference points includes placement of said graphic forms, of said second pair of reference points, on a second graduated track, said second graduated track having a second edge, said second graduated track being deployed on said movable frame such that said second edge is co-planer with said first edge, said graphic forms, of said second pair of reference points, including pointers slidably attached to said second graduated track.

19. The method of claim 18, wherein an alignment includes moving said movable frame until the viewing point lies in said plane of said first and second edges, and said positioning being performed on at least one of said pointers of said reference points.

20. The method of claim 1, wherein said designation of said first pair of reference points includes placement of said at least a first graphic form, of said first pair of reference points, on a first surface of a frame, said first surface being connected to, extending below and perpendicular to, a front edge of a second surface of said frame, said frame further having a third surface that extends above and perpendicular to said second surface, said third surface also being parallel to said first surface, said frame being supported so as to allow vertical and horizontal rotation, said at least a first graphic form, of said first pair of reference points, being deployed such that said first pair of reference points are located on said edge along which said first and second surfaces are connected.

21. The method of claim 20, wherein said designation of said second pair of reference points includes placement of said at least a second graphic form, of said second pair of reference points, on a fourth, non-connected surface, said at least a second graphic form, of said second pair of reference points, being deployed such that said second pair of reference points are located on an edge of said fourth surface, said fourth surface being deployed on said second surface and supported by said third surface so as to be perpendicular to said second surface, and orientated such that said edge on which said second pair of reference points is located is the edge of said fourth surface which is in connect with said second surface.

22. The method of claim 21, wherein said alignment includes vertical and horizontal rotation of said frame.

23. The method of claim 22, wherein said positioning includes vertical movement of said fourth surface.

24. The method of claim 1, wherein said designation of said first pair of reference points includes placement of said at least a first graphic form, of said first pair of reference points, on a first surface of a frame member, said frame member being adjustably attached to an easel frame, said easel frame further including foldable legs thereby providing support for said easel frame.

25. The method of claim 24, wherein said designation of said second pair of reference points includes placement of said at least a second graphic form, of said second pair of reference points, on a reference component, said reference component being slidably mounted on a second surface of said frame member such that said at least a first graphic form is located between said at least a second graphic form and the eye.

26. The method of claim 25, wherein an alignment is accomplished by said positioning being performed on said frame member and said reference component.

* * * * *